US006320326B1

(12) United States Patent
Shino et al.

(10) Patent No.: US 6,320,326 B1
(45) **Date of Patent: *Nov. 20, 2001**

(54) AC PLASMA DISPLAY APPARATUS

(75) Inventors: Taichi Shino, Nara-ken; Tadayuki Masumori, Osaka; Shigeo Kigo, Neyagawa; Takio Okamoto, Kusatsu, all of (JP)

(73) Assignee: Matsushita Electric Industrial Co., Ltd., Osaka (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/545,865

(22) Filed: Apr. 7, 2000

(30) Foreign Application Priority Data

Apr. 8, 1999 (JP) ..... 11-101065
Apr. 9, 1999 (JP) ..... 11-102276

(51) Int. Cl.[7] ..... G09G 3/10

(52) U.S. Cl. ..... 315/169.4; 315/169.1; 345/68; 345/67; 345/60; 345/55

(58) Field of Search ..... 315/169.4, 169.1, 315/169.2, 291; 345/68, 67, 55, 60, 61, 87

(56) References Cited

U.S. PATENT DOCUMENTS 4,320,418 * 3/1982 Pavliscak ..... 358/240
5,331,252 * 7/1994 Kim ..... 315/169.4
5,656,893 * 8/1997 Shino et al. ..... 315/169.4
5,670,974 * 9/1997 Ohba et al. ..... 345/60
5,828,353 * 10/1998 Kishi et al. ..... 345/55
5,990,630 * 11/1999 Nakamura ..... 315/169.4
6,011,355 * 1/2000 Nagai ..... 315/167.3
6,023,258 * 2/2000 Kuriyama et al. ..... 345/60

FOREIGN PATENT DOCUMENTS 0 892 384 * 1/1999 (EP) .
0 902 412 * 3/1999 (EP) .

* cited by examiner

*Primary Examiner*—Haissa Philogene
(74) *Attorney, Agent, or Firm*—Wenderoth, Lind & Ponack, L.L.P.

(57) ABSTRACT

An AC plasma display panel includes a plurality of parallel scan electrodes and a plurality of parallel sustain electrodes. Each of sustain electrodes is extended parallel to scan electrodes. Scan and sustain electrodes are positioned alternately so that each one of scan and sustain electrodes positions adjacent to and paired with the other of scan and sustain electrodes. Also, the panel includes a plurality of parallel data electrodes. The data electrodes extend substantially perpendicular to scan and sustain electrodes. Scan and sustain electrodes are applied with a certain current so that an electromagnetic noise generated in the electrodes can be cancelled by another.

8 Claims, 24 Drawing Sheets

Prior Art

AC PLASMA DISPLAY APPARATUS

FIELD OF THE INVENTION

The present invention relates to AC plasma display apparatus for use as a display device of television and computer systems.

BACKGROUND OF THE INVENTION

FIG. 6 shows a conventional AC plasma display panel and its driving circuit. The AC plasma display panel 1, herein after referred to as "panel" for clarity, has 2M rows of scan electrodes SCN(1)–SCN(2M) and sustain electrodes SUS (1)–SUS(2M), and N columns of data electrodes D(1)–D(N) each extending perpendicular to scan and sustain electrodes, forming a 2M by N matrix. Each of scan electrodes SCN(i) pairs with a corresponding sustain electrode SUS(i) so that the paired scan and sustain electrodes cooperate with one of the crossing data electrodes D(j) (integer j:1–N) to form a cell where an electric discharge will occur.

In this panel 1, lead wires of the paired scan and sustain electrodes, SCN(i) and SUS(i), are extended out in opposite directions. Also, the lead wires of the neighboring scan electrodes, for example, SCN(1) and SCN(2), are extended out in opposite directions. Likewise, the lead wires of the neighboring sustain electrodes, for example, SUS(1) and SUS(2), are extended out in opposite directions. That is, in this arrangement, the odd number of scan electrodes SCN (1), SCN(3), . . . . , SCN(2M-1) are led out to the left side of the panel and then electrically connected with a scan electrode drive circuit 2*a* for driving scan electrodes with odd number. On the other hand, the even number of scan electrodes SCN(2), SCN(4), . . . , SCN(2M) are led out to the right side of the panel and then electrically connected with a scan electrode drive circuit 2*b* for driving scan electrodes with even number. Further, the even number of sustain electrodes SUS(2), SUS(4), . . . , SUS(2M) are led out to the left side of the panel and then electrically connected with a sustain electrode drive circuit 3*b* for driving sustain electrodes with even number. On the other hand, the odd number of sustain electrodes SUS(1), SUS(3), . . . , SUS(2M-1) are led out to the right side of the panel and then electrically connected with a sustain electrode drive circuit 3*a* for driving sustain electrodes with odd number. In addition, lead wires of the data electrodes D(1)–D(N) are extended out upwardly and then electrically connected with a data electrode drive circuit 4 for driving the data electrodes.

Referring again FIG. 6 as well as FIG. 7 showing a time chart, operations of the conventional panel will be described briefly. Firstly, in a period for writing, sustain drive circuit 3*a* or 3*b* applies no signal or voltage to sustain electrodes SUS(1)–SUS(2M). For scanning in the first row scan electrode SCN(1), among data electrodes D(1)–D(N), selected one or more data electrodes D(j) corresponding to discharge cells for displaying are applied with a certain positive write pulse of +Vw volts from the data electrode drive circuit 4, and the first scan electrode SCN(1) is applied with a certain negative scan pulse of −Vs volts from scan electrode drive circuit 2*a*. This causes an electric discharge (writing discharge) at each of the intersections of the selected data electrodes D(j) and scan electrode SCN(1).

Then, for scanning in the second row scan electrode SCN(2), selected one or more data electrodes D(j) corresponding to discharge cells for displaying are applied with the write pulse of +Vw volts from the data electrode drive circuit 4, and the second scan electrode SCN(2) is applied with scan pulse of −Vs volts from another scan electrode drive circuit 2*b*. This causes the electric discharge (writing discharge) at each of the intersections of the selected data electrodes D(j) and scan electrode SCN(2). Similar operations are performed successively for scan electrodes SCN(3) to SCN(2M), causing electric discharges at discharge cells at intersections of data electrodes D(j) and scan electrodes SCN(3) to SCN(2M).

Secondly, in a subsequent period for sustaining, sustain electrode drive circuits 3*a* and 3*b* apply a negative sustain pulse of −Vm volts to every sustain electrodes SUS(1)–SUS (2M). This causes an initial sustain discharge between scan and sustain electrodes, SCN(i) and (i), in each of the discharge cells where the writing discharge has occurred in the write period. At this moment, a sustain discharge current flows from scan electrode drive circuit 2*a* through odd scan electrodes SCN(2K-1) (integer K: 1 to M) and then odd sustain electrodes SUS(2K-1) toward sustain electrode drive circuit 3*a*. Also, a sustain-discharge current flows from scan electrode drive circuit 2*b* through even scan electrodes SCN(2K) and then even sustain electrodes SUS(2K) toward sustain electrode drive circuit 3*b*.

Afterwards, sustain electrode drive circuits 3*a* and 3*b* apply no voltage to every sustain electrodes SUS(1)–SUS (2M), but scan electrode drive circuits 2*a* and 2*b* apply negative sustain pulse of −Vm volts. This causes a sustain discharge between scan and sustain electrodes, SCN(i) and SCN(i), in each of the discharge cells where the writing discharge has occurred. At this moment, sustain discharge current flows from sustain electrode drive circuit 3*a* through the odd sustain electrodes SUS(2K-1) and then odd scan electrodes SCN(2K-1) toward scan electrode drive circuit 2*a*. Also, sustain discharge current flows from sustain electrode drive circuit 3*b* through even sustain electrodes SUS (2K) and then scan electrodes SCN(2K) toward scan electrode drive circuit 2*b*.

Subsequently, scan electrodes SCN(1)–SCN(2M) and sustain electrodes SUS(1)–SUS(2M) are applied with the negative sustain pulse of −Vm volts alternatively from scan electrode drive circuits 2*a* and 2*b* and sustain electrode drive circuits 3*a* and 3*b*. This retains sustain discharge between scan and sustain electrodes, SCN(i) and (i), at each of the discharge cells where the writing discharge have occurred. This in turn allows sustain discharge current to flow from sustain electrode drive circuit 3*a* to scan electrode drive circuit 2*a* and from sustain electrode drive circuit 3*b* to scan electrode drive circuit 2*b*. In addition, sustain discharge current flows from scan electrode drive circuit 2*a* to sustain electrode drive circuit 3*a* and from scan electrode drive circuit 2*b* to sustain electrode drive circuit 3*b*.

In the subsequent period for erasing, all sustain electrodes SUS(1)–SUS(2M) are applied with a short negative erase pulse of −Ve volts from sustain electrode drive circuits 3*a* and 3*b*, causing an erase discharge at each of the discharge cells to erase sustain discharge.

With the operations described above, one frame of image is displayed on the panel by the use of light emitted during sustain discharge.

Referring to FIG. 8, there is illustrated a schematic enlarged plan view of a part of the panel shown in FIG. 6, in particular electrodes positioned in rows from (2K-1) to (2K). In this drawing, sustain discharge current flowing at the first sustain discharge in sustain period is shown. In particular in this drawing, bold arrows indicate the directions along which sustain discharge current flows in respective electrodes, and normal arrows indicate the directions along which sustain discharge current flows from one electrode to another. As can be seen from the drawing, the direction that sustain electrode current flows in the odd scan and sustain electrodes, SCN(2K-1) and (2K-1), is opposite to that sustain discharge current in the even scan and sustain electrodes, SCN(2K) and SUS(2K). With this opposite flows of sustain discharge current in the odd and even electrodes, a vector of electromagnetic wave caused from the odd scan and sustain electrodes, SCN(2K-1) and SUS(2K-1) opposes to and counteracts another vector of that caused from the even scan and sustain electrodes, SCN(2K) and SUS(2K). This means that, because most of the electromagnetic waves or noises are those generated by sustain discharge current running through the electrodes at sustain discharge, a panel with a reduced electromagnetic noise can be provided.

The conventional panel, however, is designed so that scan electrode drive circuits 2*a* and 2*b* and also sustain electrode drive circuits 3*a* and 3*b* are provided on opposite sides for odd and even electrodes. Therefore, it has been found that even a slight time shift between operations of scan electrode drive circuits 2*a* and 2*b* or between sustain electrode drive circuits 3*a* and 3*b* renders the counteraction of the electromagnetic noises unstable.

Descriptions will be made to the reasons of the unstable counteraction with reference to FIGS. 9(*a*) to 9(*e*) showing waveforms of sustain pulse voltage of −Vm volts and waveforms of sustain discharge current that flows through scan and sustain electrodes, at the first sustain discharge in sustain period. It should be noted that in each of FIGS. 9(*a*) to 9(*e*) a horizontal axis, i.e., time axis, has different scales at its left and right portions.

Specifically, FIG. 9(*a*) illustrates the waveform of voltage applied to the odd scan electrodes SCN(2K-1) relative to sustain electrode drive circuit 3*a* when sustain pulse voltage of −Vm volts is applied from sustain electrode drive circuit 3*a* to the odd sustain electrode (2K-1).

Also, FIG. 9(*b*) illustrates the waveform of sustain discharge current flowing from scan electrode drive circuit 2*a* through the odd scan electrodes SCN(2K-1) and also odd sustain electrode SUS(2K-1) to sustain electrode drive circuit 3*a* when sustain pulse of −Vm volts is applied from sustain electrode drive circuit 3*a* to the odd sustain electrode (2K-1). FIG. 9(*c*) illustrates the waveform of voltage applied to the even sustain electrodes SUS(2K) relative to scan electrode drive circuit 2*b* when sustain pulse of −Vm volts is applied from sustain electrode drive circuit 3*b* to the even sustain electrodes SUS(2K).

Further, FIG. 9(*d*) illustrates the waveform of sustain discharge current flowing from sustain electrode drive circuit 3*b* through the even sustain electrode SUS(2K) and also even scan electrode SCN(2K) to scan electrode drive circuit 2*b* when sustain pulse of −Vm volts is applied from sustain electrode drive circuit 3*b* to the even sustain electrode SUS(2K).

Furthermore, FIG. 9(*e*) illustrates a resultant current waveform of current waveforms shown in FIGS. 9(*b*) and 9(*d*).

It should be noted that the voltage and current waveforms are illustrated with the flowing directions of the current in order to effectively describe the counteraction of the electromagnetic noises.

As shown in FIGS. 9(*b*) and 9(*d* ), the discharge sustain current is a resultant of two currents, Id and Ic. The current Id, which serves to the actual light emission, starts flowing slightly after the application of sustain pulse voltage. The current IC, which flows in response to a capacitance between scan and sustain electrodes, has an extremely narrow period, or is in the form of sharp peak. Therefore, the current IC is ineffective for the light emission, but causes unwanted electromagnetic noises.

Also, as indicated by solid lines in FIGS. 9(*b*) and 9(*d*), if sustain electrode drive circuit 3*a* drives in synchronous with sustain electrode drive circuit 3*b* and thereby sustain pulses from those circuits are applied simultaneously, the resultant current waveform is minimized as best shown in FIG. 9(*e*). This means that the electromagnetic noises counteract to each other. On the other hand, as shown by dotted lines in FIGS. 9(*c*) and 9(*d*), if sustain electrode drive circuit 3*a* drives out of synchronous with sustain electrode drive circuit 3*b* and thereby sustain pulses from those circuits are applied in different times, the resultant current waveform has two sharp peaks of opposite polarities as shown in FIG. 9(*e*). This means that the electromagnetic noises does not counteract to each other, resulting in increased electromagnetic noises.

Further, as shown in FIG. 9(*b*) or 9(*d*), typically, the ineffective current waveform IC is a sharp, narrow peak with a period of several nanoseconds. Then, in order to minimize the resultant current waveform as shown by solid lines in FIG. 9(*e*), a time shift between operations of sustain electrode drive circuits 3*a* and 3*b* should be minimized. For those purposes, responses of the circuits as well as response stability thereof should be reduced to about several hundred picoseconds, which is considered to be impossible. In view of above, the counteraction of the electromagnetic noises is not ensured positively, which is a great problem to be solved.

Referring to FIG. 22, an AC plasma display system includes a display panel and its driving units in which an image is displayed by sustaining discharge between neighboring scan and sustain electrodes. As can be seen from the drawing, the panel 1*a* includes M rows of scan electrodes SCN(1)–SCN(M), and M rows of sustain electrodes SUS (1)–SUS(M) each extending parallel to scan electrodes, and N columns of data electrodes D(1)–D(N). Each row consists of paired scan and sustain electrodes, and scan and sustain electrodes are positioned alternately. Scan and sustain electrodes are led out in the opposite directions and then connected with scan electrode drive circuit 2 and sustain electrode drive circuit 3, respectively. Two scan electrodes defining SCN(1) are led out on the left side of the panel where they are electrically connected with scan electrode drive circuit 2, and two sustain electrodes defining SUS(1) are led out on the right side of the panel where they are electrically connected with sustain electrode drive circuit 3.

Intersections between paired scan and sustain electrodes and data electrodes define discharge cells, indicated at C(11)–C(MN). Therefore, in this panel, discharge cells each include two scan and sustain electrodes, forming M by N matrix.

Referring to FIG. 23 showing an operational time chart, operations of the panel will be described. Firstly, in the write period all of sustain electrodes SUS(1)–SUS(M) is retained at zero volt by sustain electrode drive circuit 3. In the first row or line scanning, among data electrodes D(1)–D(N), one or more data electrodes D(j) (integer j: 1–N)for displaying image are applied with positive write pulse of +Vw volts from the data electrode drive circuit 4, and the first row scan electrode SCN(1) is applied with negative scan pulse of −Vs volts. This causes a write discharge at the discharge cell C(1,j), intersection of the data electrode D(j) and scan electrode SCN(1).

Secondly, in the second row or line scanning, among data electrodes D(1)–D(N) one or more data electrodes D(j) for displaying image are applied with positive write pulse of +Vw volts from the data electrode drive circuit 4, and the second row scan electrode SCN(2) is applied with negative scan pulse of −Vs volts. This causes the write discharge at the discharge cell C(2,j), intersection of the data electrode D(j) and scan electrode SCN(2).

Similar operations are repeated for the remaining rows, i.e., up to M row, causing writing discharge at selected discharge cells.

In the next sustain period, all of sustain electrodes SUS (1)–SUS(M) are applied from sustain electrode drive circuit 3 with the negative sustain pulse of −Vm volts. This causes the initial sustain discharge between scan electrode SCN(i) (integer i:1−M) and sustain electrode SUS(i) at the discharge cell C(i,j) where the write discharge has been occurred. This in turn causes a certain current to flow from scan electrode drive circuit 2 through scan electrode SCN(i) and then sustain electrode SUS(i) toward sustain electrode drive circuit 3. Next, scan electrodes SCN(1)–SCN(M) and sustain electrodes SUS(1)–SUS(M) are applied with negative sustain pulse of −Vm volts alternately from scan electrode drive circuit 2 and sustain electrode drive circuit 3. This retains sustain discharge between scan electrode SCN(i) and sustain electrode SUS(i) at each of the discharge cells C(i,j) where the write discharge has occurred. This in turn causes a certain current to flow from sustain electrode drive circuit 3 through sustain electrode SUS(i) and then scan electrode SCN(i) toward scan electrode drive circuit 2 and from scan electrode drive circuit 2 through scan electrode SCN(i) and then sustain electrode SUS(i) toward sustain electrode drive circuit 3, alternately. Sustain discharge emits light for display.

In the next erase period, all of sustain electrodes SUS(1) –SUS(M) are applied with negative narrow pulse of −Ve volts from sustain electrode drive circuit 3, causing an erasing discharge to erase sustain discharge.

With the above-described operations, one frame of image is displayed on the panel. Also, in each of discharge cell two discharges are generated, each discharge is generated between paired scan and sustain electrodes. This causes that an extended light emission is provided at each discharge cell, increasing the brightness of the resultant image.

However, the conventional AC plasma display panel has a drawback that intense electromagnetic noises are generated by sustain discharge current at sustain discharging.

Descriptions will be made to the drawback in detail hereinafter. Referring to FIG. 24, there is shown a part of the panel in which electrodes of from (i−1)th to (i+1)th rows are electrically connected with scan electrode drive circuit 2 and sustain electrode drive circuit 3. Also, FIG. 24 shows sustain discharge current (shown by solid lines) generated by an application of negative sustain pulse of −Vm volts to sustain electrodes SUS(1)–SUS(M) at a certain time (t) in sustain period shown in FIG. 23. As can be seen from the drawing, in each row two sustain discharge currents flowing in the paired scan and sustain electrodes run in the same direction. For example, in row (i) the first discharge current from one scan electrode SCN(i,a) to one sustain electrode SUS(i,a) flows in the same direction as the second discharge current from the other scan electrode SCN(i,b) to the other sustain electrode SUS(i,b). This means that in each row the two sustain discharge currents flows in the same direction from scan to sustain electrodes, causing electromagnetic noises with the same phase due to sustain discharge currents. Also, the electromagnetic noises with the same phase are superimposed to generate a greater electromagnetic noise which would be emitted from the panel. Also, as indicated by dotted lines in FIG. 24, in each row the current flows through the capacitance between both paired scan and sustain electrodes, e.g., from scan electrode SCN(i,b) to sustain electrode SUS(i,a) in the same direction, i.e., left to right. Also, as indicated by broken lines in FIG. 24, the current flows through the capacitance between both paired scan and sustain electrodes, e.g., from scan electrode SCN(i,a) to sustain electrode SUS(i-1,b) in the same direction, i.e., left to right. Therefore, the electromagnetic noise generated by the current flowing through capacitance has the same phase as that generated by sustain discharge current in every row.

In view of above, the flowing direction of sustain discharge current from scan to sustain electrodes as well as the flowing direction of the current from scan electrode through the capacitance to sustain electrode in one row is the same as those in another row, causing an intense electromagnetic noise, which is a great problem to be solved.

SUMMARY OF THE INVENTION

Therefore, an object of the present invention is to provide an AC plasma display panel capable of minimizing the electromagnetic noise possibly caused by the current flowing in the electrodes.

Accordingly, an AC plasma display panel of the present invention includes a plurality of parallel scan electrodes; a plurality of parallel sustain electrodes, each of the sustain electrodes extending parallel to the plurality of scan electrodes, wherein the plurality of scan and sustain electrodes are positioned so that each one of the scan and sustain electrodes positions adjacent to and paired with the other one of scan and sustain electrodes; a plurality of parallel data electrodes, the data electrodes extending substantially perpendicular to the scan and sustain electrodes; means for applying a certain current to the scan and sustain electrodes so that the current in the paired scan and sustain electrodes respectively flows in opposite directions each other.

Another AC plasma display panel of the present invention includes a plurality of discharge cells, the plurality of discharge cells being arrange in a matrix made of plurality of rows and columns, wherein each of the discharge cells includes two pairs of scan and sustain electrodes extending in one direction and a data electrode extending substantially perpendicular to the one direction, means for applying a certain current to the scan and sustain electrodes so that the current in one of the two pairs flows in one direction and the current in the other of the two pairs flows in the opposite direction.

Another AC plasma display panel of the present invention includes a plurality of parallel scan electrodes; a plurality of parallel sustain electrodes, each of the sustain electrodes extending parallel to the plurality of scan electrodes, wherein the plurality of scan and sustain electrodes are positioned so that each one of the scan and sustain electrodes positions adjacent to and paired with the other one of scan and sustain electrodes; a plurality of parallel data electrodes, the data electrodes extending substantially perpendicular to the scan and sustain electrodes to form discharge cells at intersections of the scan and sustain electrodes and the data electrodes, wherein each of the discharge cells is defined by two pairs of scan and sustain electrodes and the data electrode; means for applying a certain current to each of the paired scan and sustain electrodes, the current in one of the two pairs flows in one direction and the current in the other of the two pairs flows in the opposite direction.

DETAILED DESCRIPTION OF THE PREFERRED EMBODIMENTS

Figure 1:
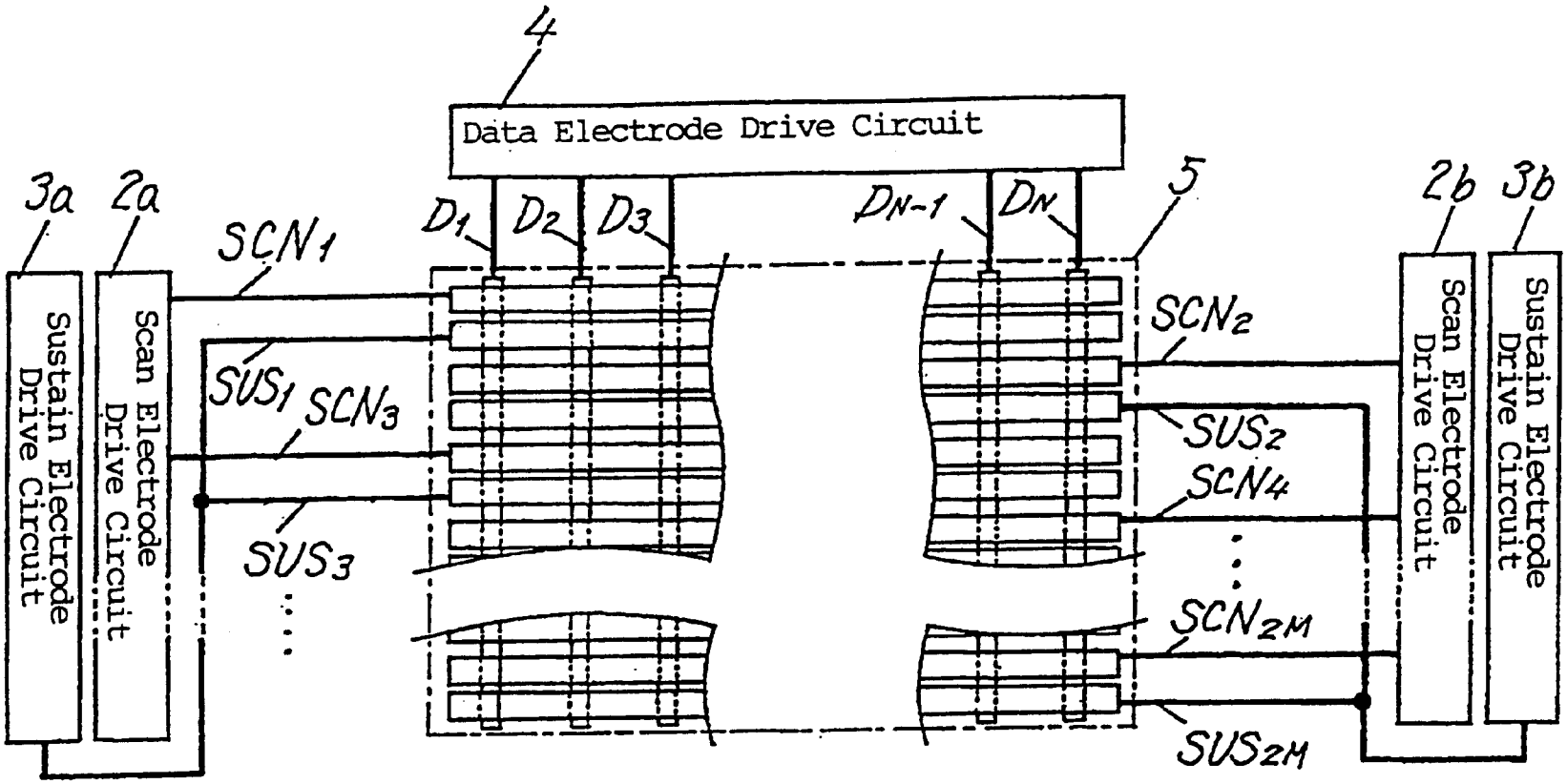
FIG. 1 is a schematic elevational view of an AC plasma display panel according to the first embodiment of the present invention.

With reference to the drawings, various embodiments of the present invention will be described hereinafter. Note that like parts and elements are designated like reference numerals throughout the drawings.

FIRST EMBODIMENT

FIG. 1 shows an AC plasma display panel according to the first embodiment of the present invention. As shown in FIG. 1, the panel 5 includes 2M scan electrodes, SCN(1)–SCN (2M), and 2M sustain electrodes, SUS(1)–SUS(2M), extending in the same direction. Also, scan electrodes SCN (1)–SCN(2M) pair with sustain electrodes SUS(l)–SUS (2M), respectively. The panel 5 further includes N data electrodes, D(1)–D(n) extending perpendicular to scan and sustain electrodes, forming a matrix of 2M by N therewith. Also, at each intersection where neighboring paired scan and sustain electrodes, SCN(i) and SUS(i), cross the data electrode D(j), there is formed a discharge cell where a sustain discharge generated between the paired scan and sustain electrodes, SCN(i) and SUS(i), forming a pixel of a resulting image.

In particular, the paired scan and sustain electrodes, SCN(i) and SUS(i) are led out to the same side. For example, the paired scan and sustain electrodes, SCN(1) and SUS(1) are led out to the left side of the panel 5. Also, the neighboring pairs are led out on the opposite sides of the panel 5. For example, the paired electrodes SCN(1) and SUS(1) are led out to the left side and another paired electrodes SCN(2) and SUS(2) are led out to the right side of the panel 5.

More specifically, the lead wires of the odd scan electrodes SCN(2K-1) and sustain electrodes SUS(2K-1) are extended out to the left side of the panel 5. On the other hand, the lead wires of the even scan electrodes SCN(2K) and sustain electrodes SUS(2K) are extended out to the right side of the panel 5. Also, the odd scan electrodes SCN(2K-1) are electrically connected with a scan electrode drive circuit 2*a* for applying a certain pulse or voltage to drive the odd scan electrodes. Likewise, the odd sustain electrodes SUS (2K-1) are electrically connected with a sustain electrode drive circuit 3*a* for applying a certain pulse or voltage to drive the odd sustain electrodes. On the other hand, the even scan electrodes SCN(2K) are electrically connected with a scan electrode drive circuit 2*b* for applying a certain pulse or voltage to drive the even scan electrodes. Likewise, the even sustain electrodes (2K) are electrically connected with a sustain electrode drive circuit 3*b* for applying a certain pulse or voltage to drive the even sustain electrodes. The data electrodes D(1)–D(N) are led out upwardly and electrically connected with a data electrode drive circuit 4 for applying a certain pulse or voltage to drive the data electrodes.

Figure 7:
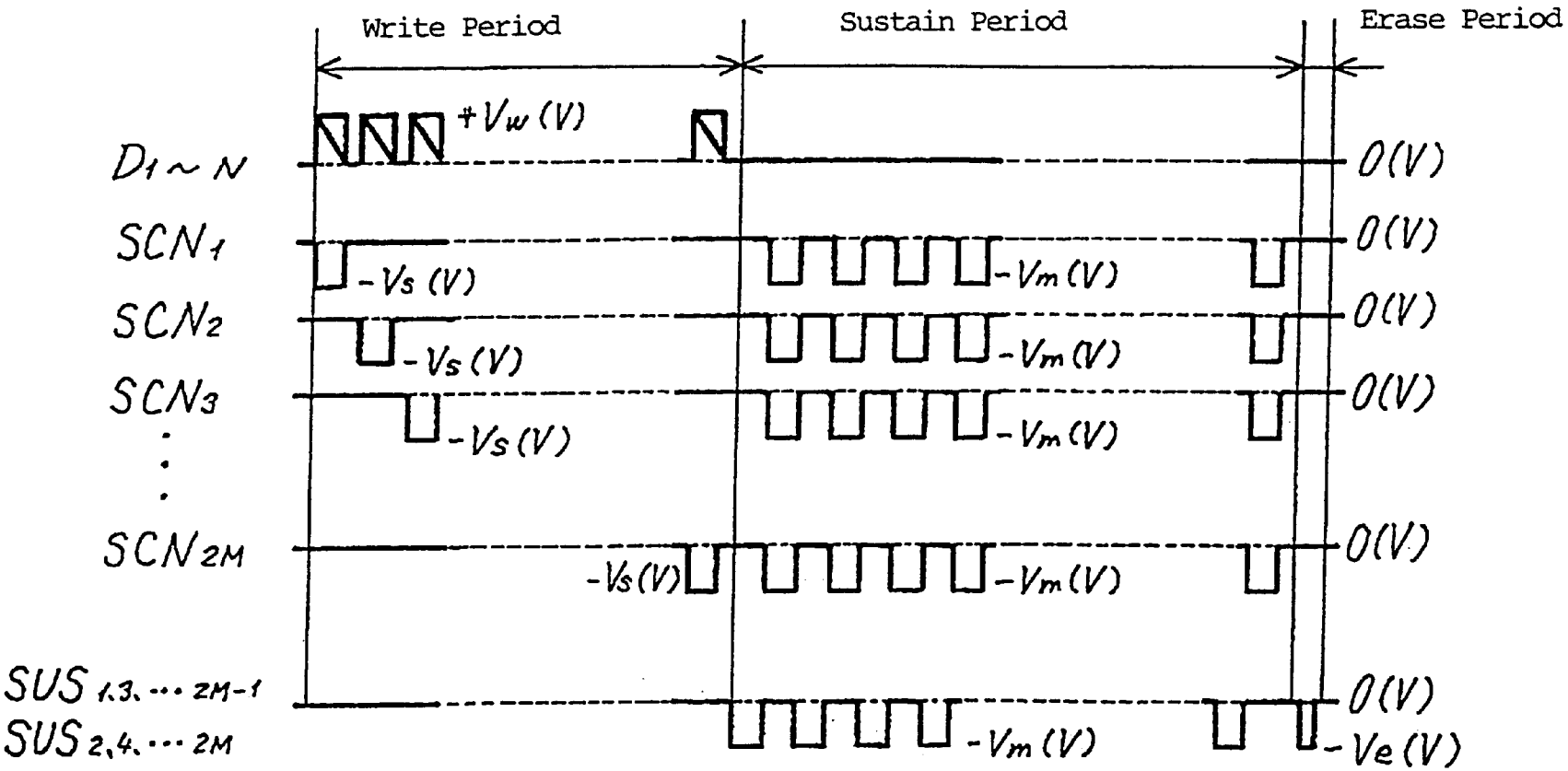
Fig. 7 Prior Art
FIG. 7 is a time chart showing pulses applied to electrodes in the AC plasma display panel shown in FIG. 6.
Figure 8:
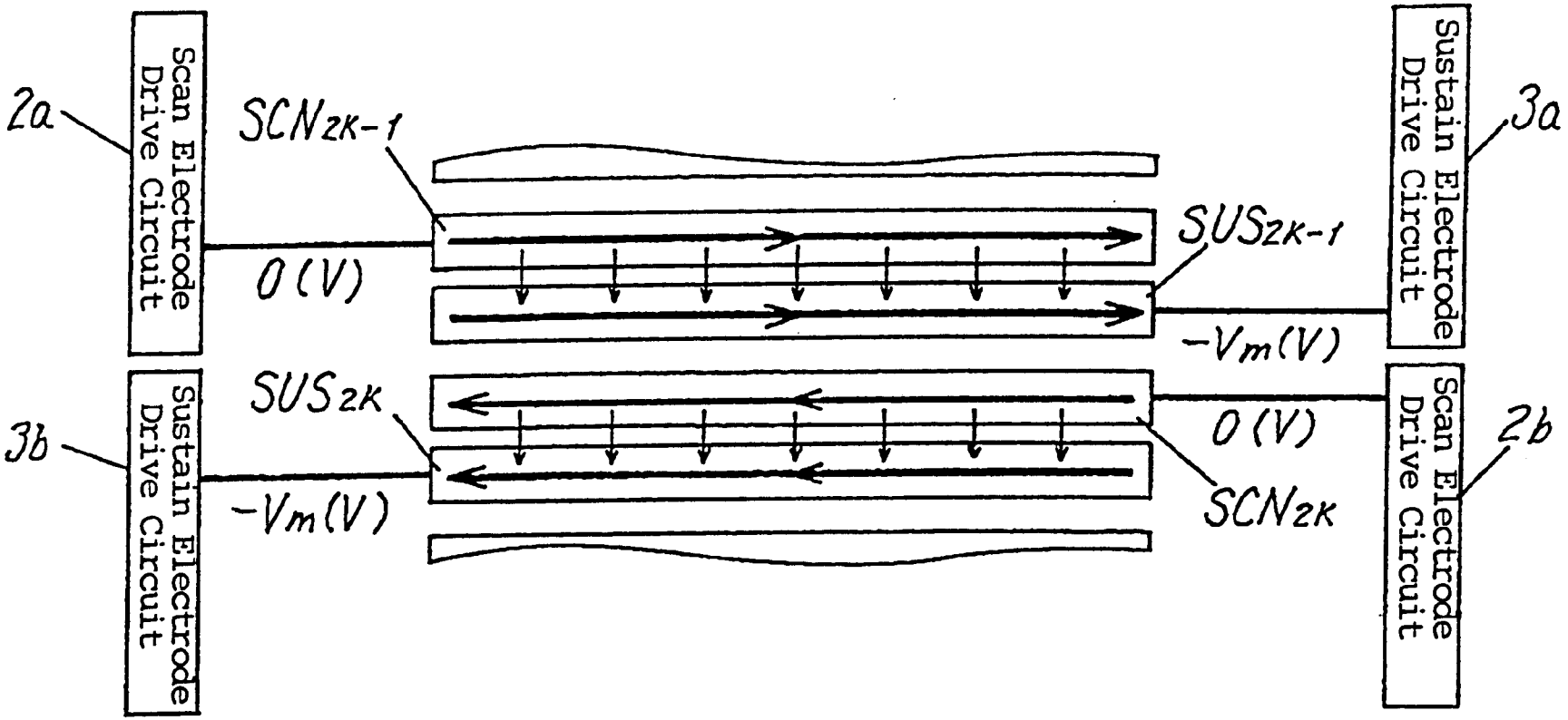
Fig. 8 Prior Art
FIG. 8 is a partial schematic elevational view of the conventional AC plasma display panel showing an arrangement of the electrodes.
Figure 9:
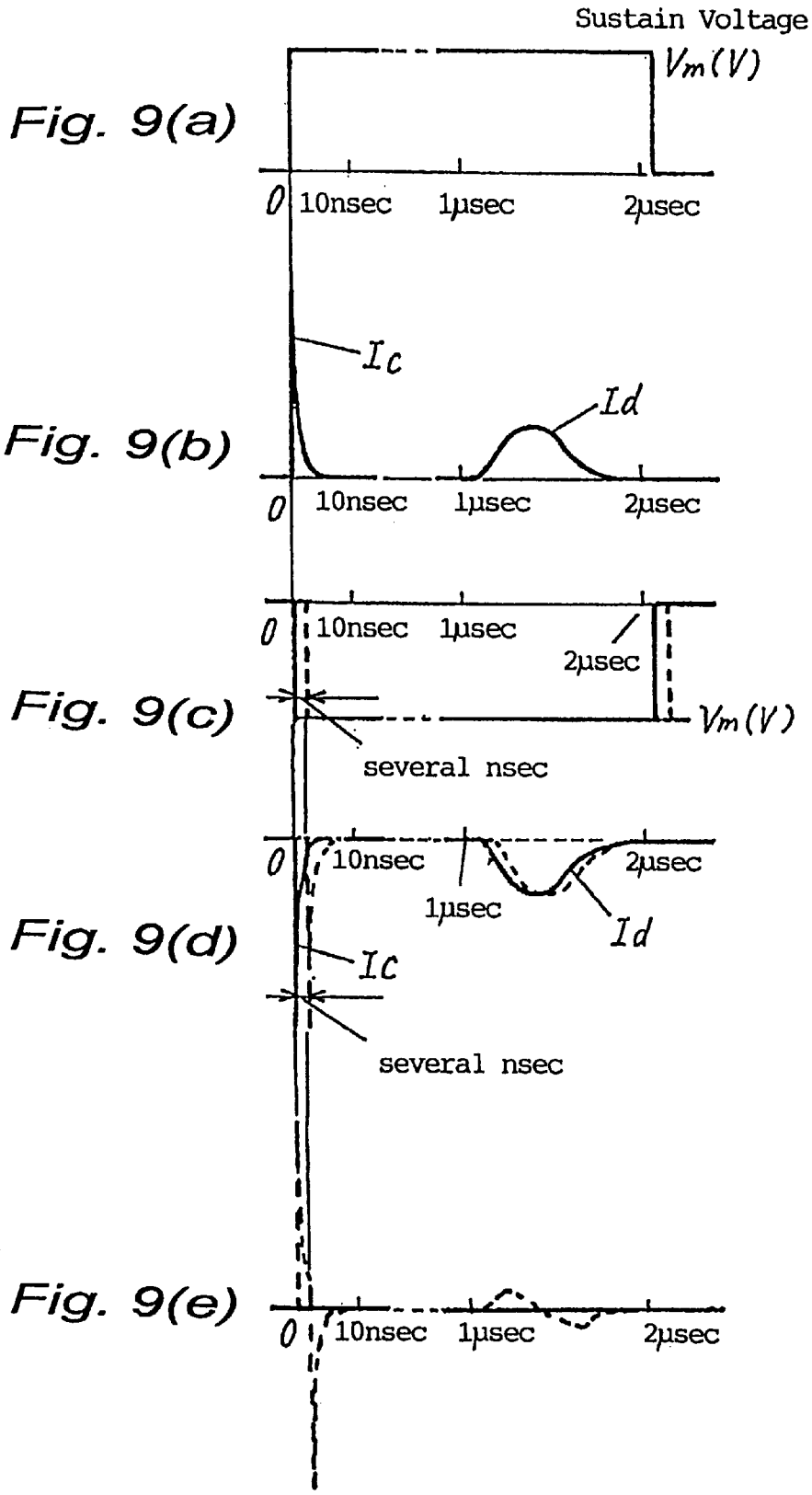
FIGS. 9(*a*) to 9(*e*) are graphs each showing time versus voltage or current applied to the electrodes shown in FIG. 8.

In this arrangement, the panel 5 can be operated in the conventional manner shown according to the operational time chart shown in FIG. 7 which has been described above and therefore no further description will be made to this.

Hereinafter, operations and advantages of the AC plasma display panel according to the first embodiment of the present invention will be described.

Figure 2:
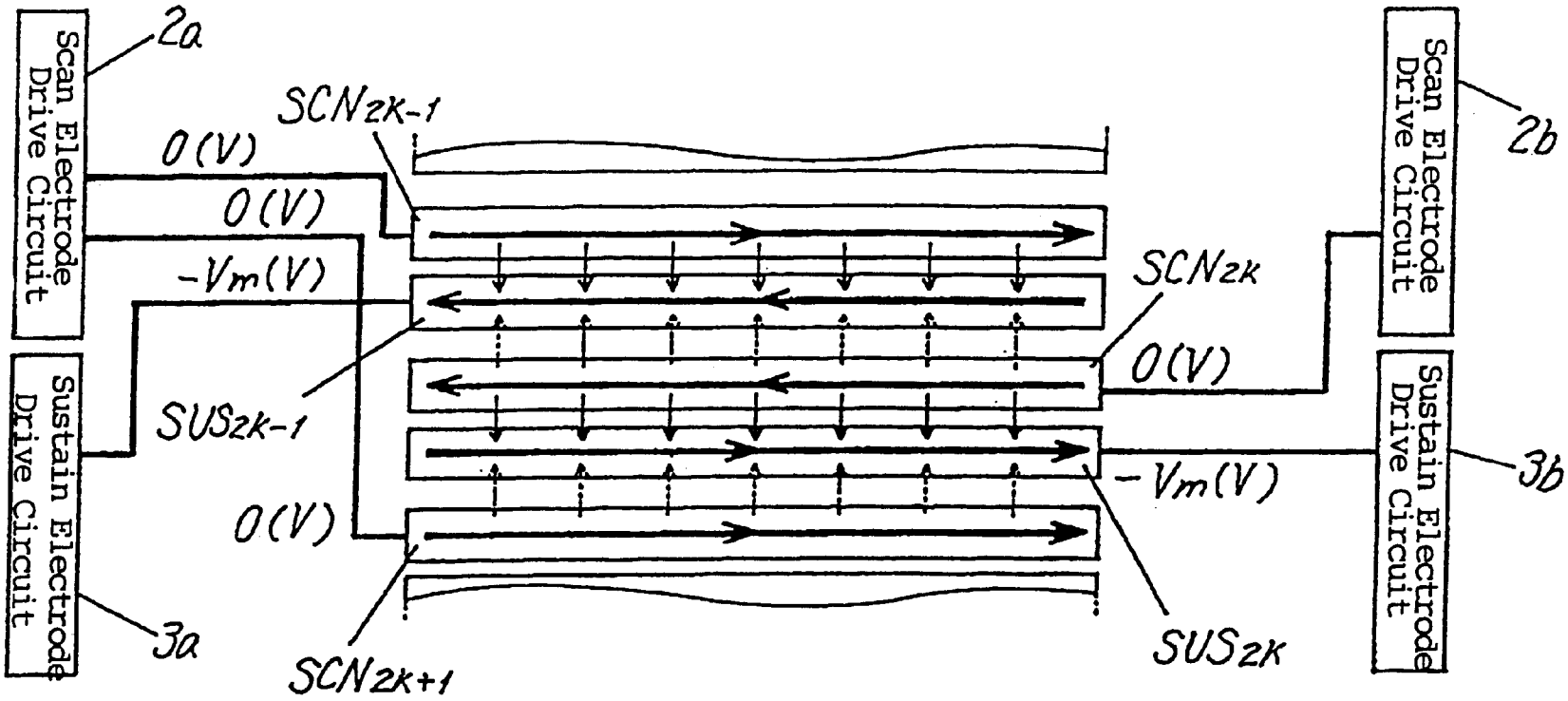
FIG. 2 is a partial schematic elevational view of the AC plasma display panel in FIG. 1.
Figure 3A:
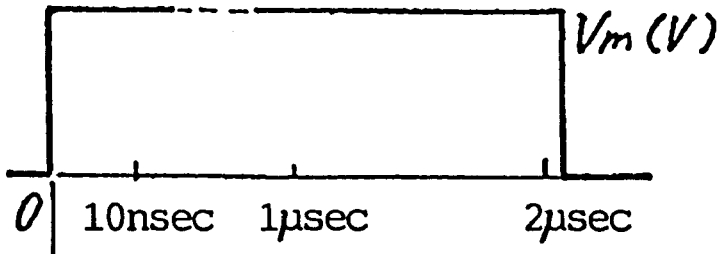
FIGS. 3(*a*) to 3(*d*) are graphs each showing time versus voltage or current applied to the electrodes shown in FIG. 2.
Figure 3B:
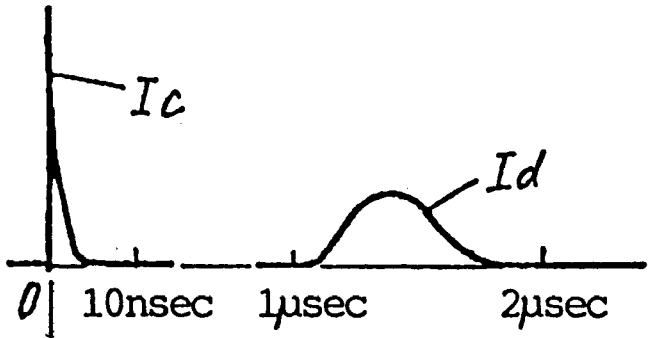
Figure 3C:
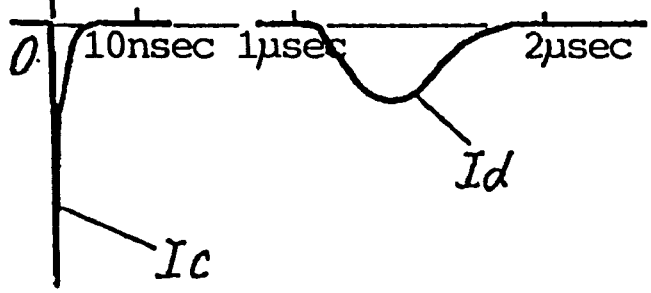
Figure 3D:
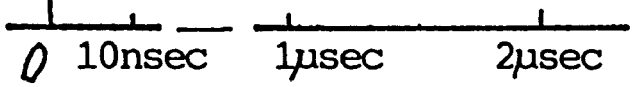

FIG. 2 shows an arrangement including paired electrodes of (2K-1)-th and (2K)-th rows in the panel 5 shown in FIG. 1. This drawing illustrates directions of sustain discharge currents flowing at the first sustain discharge in sustain period, in which each of bold arrows shows sustain discharge current flowing in the electrode and each of normal arrows shows sustain discharge current flowing between neighboring electrodes.

As can be seen from the drawing, sustain discharge currents in the paired odd scan electrode SCN(2K-1) and sustain electrode SUS(2K-1) are directed in the opposite directions. Likewise, sustain discharge currents in the paired even scan electrode SCN(2K) and sustain electrode SUS (2K) are directed in the opposite directions. The paired scan and sustain electrodes are provided with a certain current simultaneously so that the current flows in the paired scan and sustain electrodes in the opposite directions because they are applied from any one of scan and sustain electrode drive circuits, 2*a*, 2*b*, 3*a*, and 3*b*. Therefore, electromagnetic waves generated by sustain discharge currents flowing in the paired scan and sustain electrodes, SCN(2K-1) and SUS (2K-1), can be designed so that they have vector components with the same magnitude in the opposite directions. Likewise, electromagnetic waves generated by sustain discharge currents flowing in the paired scan and sustain electrodes, SCN(2K) and SUS(2K), can be designed so that they have vector components with the same magnitude in the opposite directions. This allows the generated electromagnetic noises to counteract or cancel to each other.

FIGS. 3(*a*) to 3(*d*) show waveforms of sustain pulse of −Vm volts and current flowing in scan and sustain electrodes.

It should be noted that in each of FIGS. 3(*a*) to 3(*d*) a horizontal axis, i.e., time axis, has different scales at its left and right portions.

Specifically, FIG. 3(*a*) illustrates the waveform of voltage applied to the odd scan electrodes SCN(2K-1) when sustain pulse of −Vm volts is applied from sustain electrode drive circuit 3*a* to the odd sustain electrode SUS(2K-1), and also illustrates the waveform of voltage applied to the even sustain electrodes SUS(2K) when sustain pulse of −Vm volts is applied from sustain electrode drive circuit 3*b* to the even sustain electrode SUS(2K).

Also, FIG. 3(*b*) illustrates the waveform of sustain discharge current flowing from scan electrode drive circuit 2*a* to the odd scan electrodes SCN(2K-1) or from scan electrode drive circuit 2*b* to the even scan electrode SCN(2K) when sustain pulse voltage of −Vm volts is applied from sustain electrode drive circuit 3*a* to the odd sustain electrode SUS(2K-1).

Further, FIG. 3(*c*) illustrates the waveform of sustain discharge current flowing from sustain electrode SUS(2K-1) to sustain electrode drive circuit 3*a*, or from sustain electrode SUS(2K) to sustain electrode drive circuit 3*b*.

Furthermore, FIG. 3(*d*) illustrates a resultant current waveform of current waveforms shown in FIGS. 3(*b*) and 3(*c*).

It should be noted that both of the waveforms shown in FIGS. 3(*b*) and 3(*c*) are waveforms of sustain discharge current supplied from sustain drive circuit 3*a* or 3*b* and, therefore, no time shift exists between waveforms of sustain discharge currents shown in FIGS. 3(*b*) and 3(*c*) irrelevant to the operations of sustain electrode drive circuits 3*a* and 3*b*.

The operations and advantages caused between (2K-1)-th and (2K)-th electrodes are obtained in the entire area of the panel 5 in FIG. 1. That is, each of the electromagnetic noises caused by sustain discharge current flowing in the odd scan and sustain electrodes can be cancelled by another. Irrelevant to this, each of the electromagnetic noises caused by sustain discharge current flowing in the even scan and sustain electrodes can be cancelled by another.

In the first embodiment, as shown in FIG. 2, the lead wires of the paired scan and sustain electrodes are extended out to the opposite directions, left and right sides, alternately. Then, the extended lead wires occupy a reduced area. This in turn means that a greater gap can be provided between neighboring lead wires of the panel.

Also, for the ineffective current that flows in the capacitance where no sustain discharge would occur, i.e., capacitance between sustain electrode SUS(2K-1) and scan electrode SCN(2K) and capacitance between sustain electrode SUS(2K) and scan electrode SCN(2K+1), the current flowing in sustain electrode SUS(2K-1) and scan electrode SCN(2K) is oriented opposite to that in sustain electrode SUS(2K) and scan electrode SCN(2K+1). Therefore, a possible time shift in the operations of between sustain electrode drive circuits 3*a* and 3*b* or scan electrode drive circuits 2*a* and 2*b* results in that the electromagnetic noises may not be cancelled by another. However, since a greater space is provided between the paired scan and sustain electrodes in order to prevent an accidental discharge, a capacitance is very small between electrodes, i.e., one scan electrode and the neighboring sustain electrode, where no sustain discharge would occur. This means that no practical problem would occur due to the electromagnetic noises that has not been cancelled. Actually, tests showed that according to the 42 -inch AC plasma display panel according to the first embodiment of the present invention, electromagnetic noises are reduced by about 15 dB compared with the conventional panel.

Although in the AC plasma display panel according to the first embodiment of present invention the paired scan and sustain electrodes are led out in the same direction and the pairs are directed in opposite directions alternately, similar and other advantages can be obtained provided that the paired electrodes are led out to the same direction.

SECOND EMBODIMENT

Figure 4:
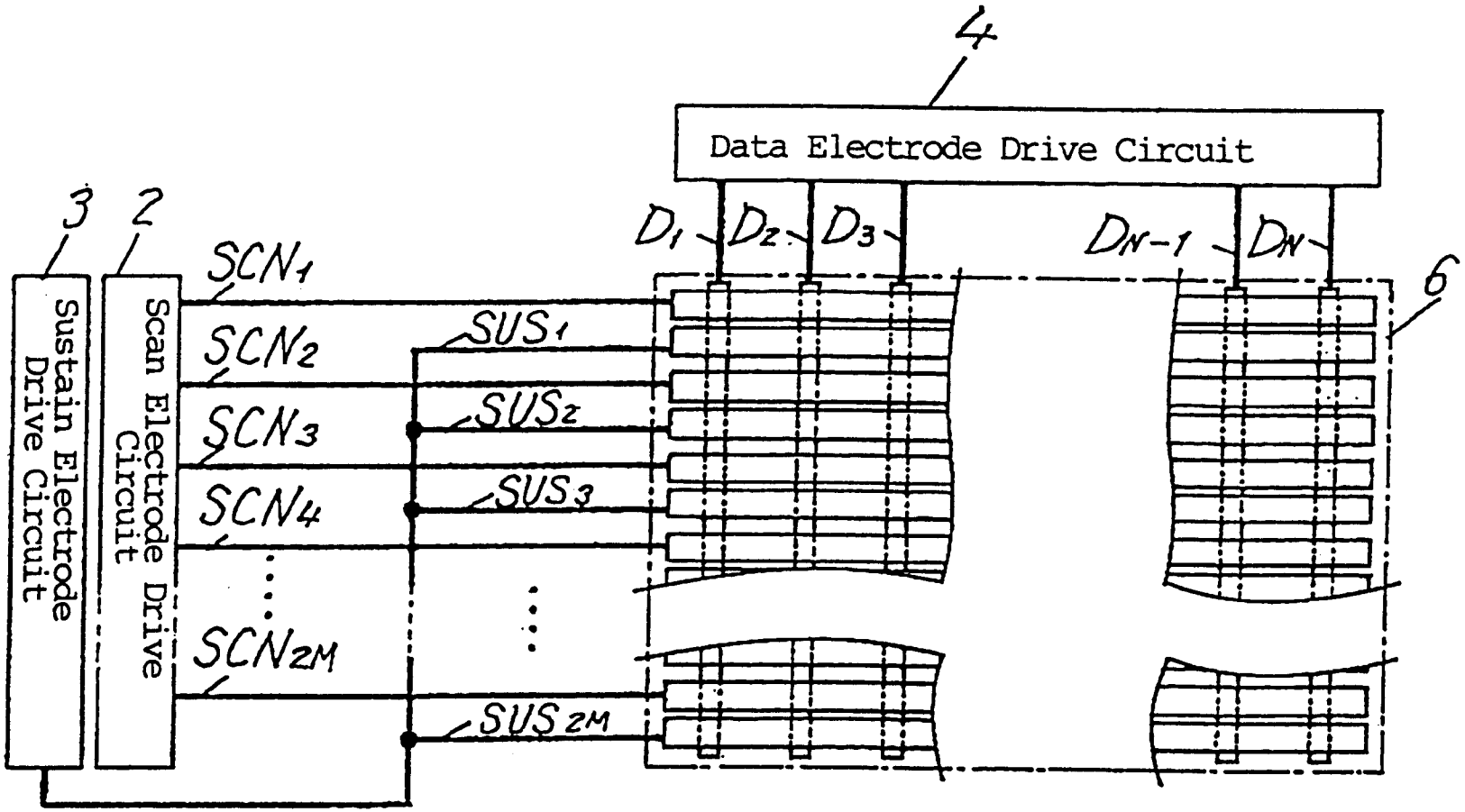
FIG. 4 is a partial schematic elevational view of an AC plasma display panel according to the second embodiment of the present invention.

FIG. 4 shows another AC plasma display panel 6 according to the second embodiment of the present invention. The panel is similar to that described in the first embodiment except that all scan electrodes SCN(1)–SCN(2M) are led out to the left side of the panel 6 and then electrically connected with scan electrode drive circuit 2 for driving those electrodes, and also all sustain electrodes SUS(1)–SUS(2M) are led out to the left side of the panel 6 and then electrically connected with sustain electrode drive circuit 3 for driving those electrodes. Further, the data electrodes D(1)–D(N) are led out upwardly and then electrically connected with the data drive circuit 4 for driving those electrodes.

In this arrangement, although each of scan electrode drive circuit 2 and sustain electrode drive circuit 3 is made of one circuit and not separated into two as shown in the previous embodiment, the panel 6 can be operated in the conventional manner according to the operational time chart shown in FIG. 7 which has been described above and therefore no further description will be made to this.

Hereinafter, operations and advantages of the AC plasma display panel according to the second embodiment of the present invention will be described.

Figure 5:
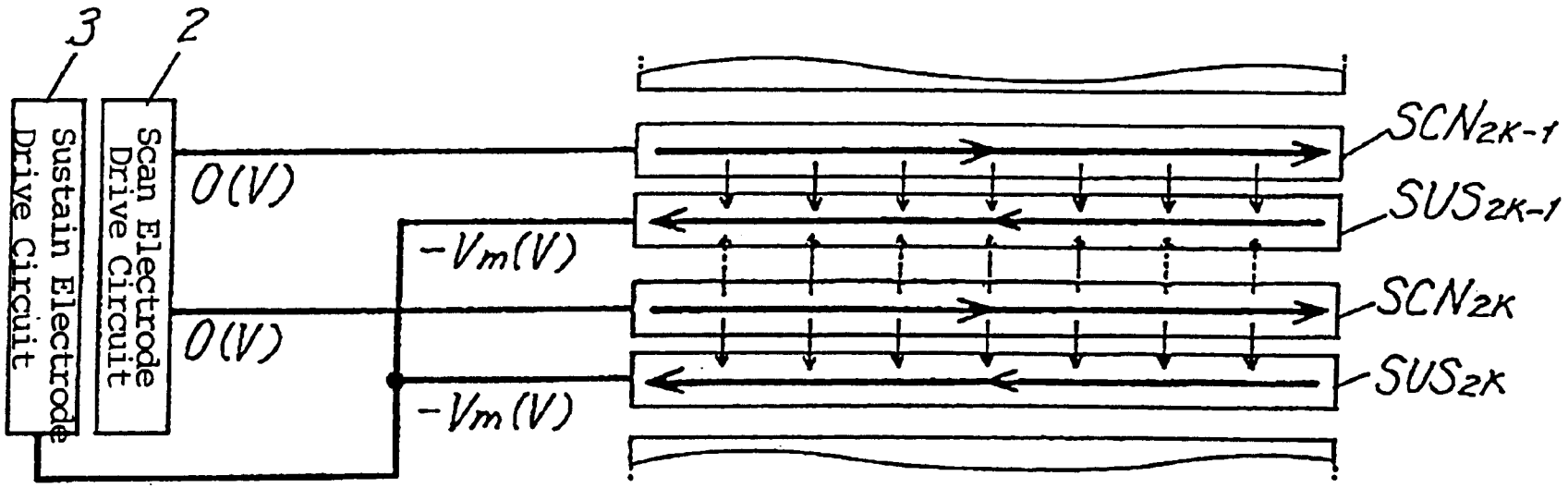
FIG. 5 is a partial schematic elevational view of the AC plasma display panel in FIG. 4.
Figure 6:
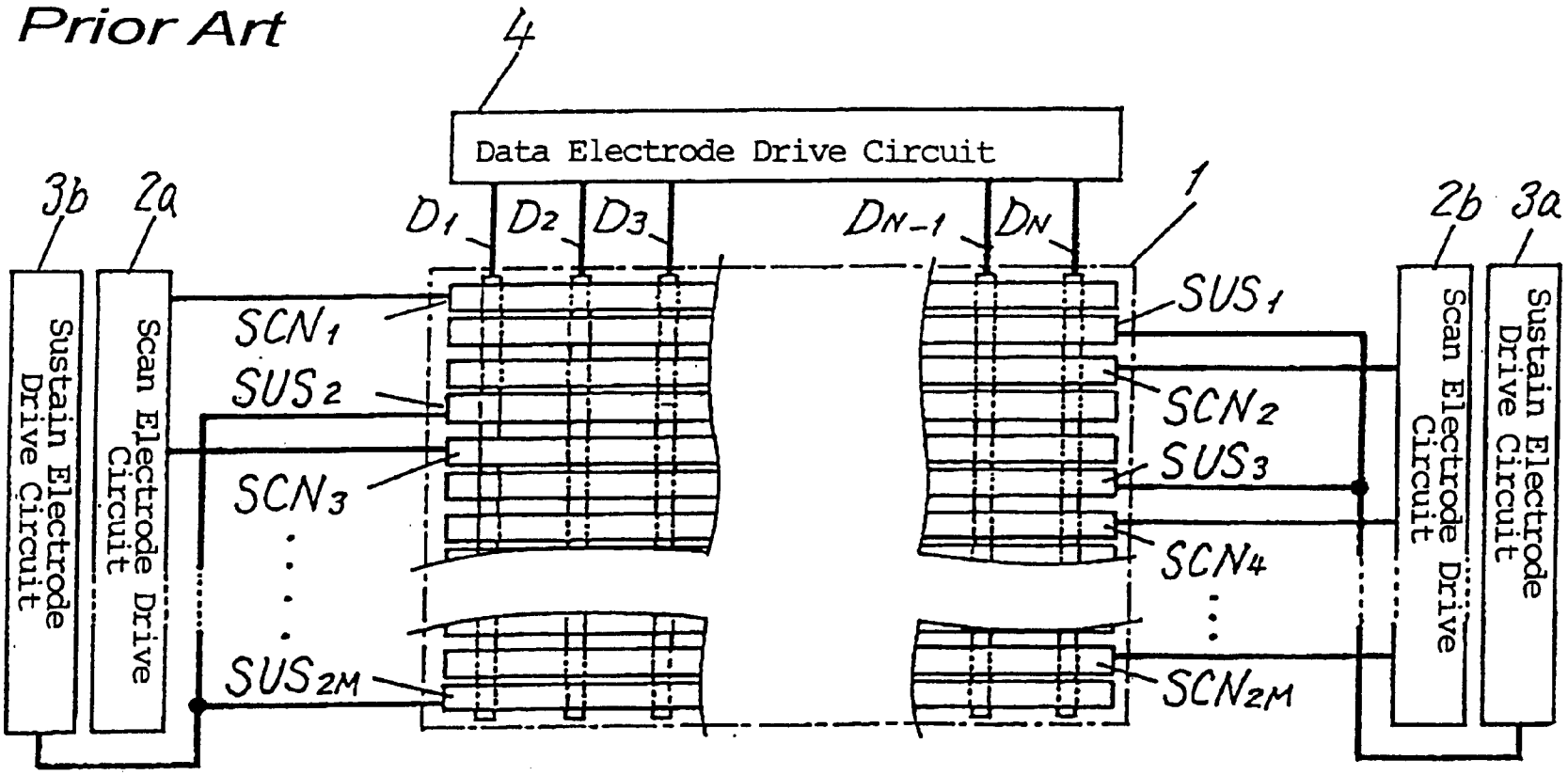
Fig. 6 Prior Art
FIG. 6 is a schematic elevational view of a conventional AC plasma display panel.

FIG. 5 shows an arrangement including paired electrodes of (2K-1)-th and (2K)-th rows in the panel 6 shown in FIG. 4. As can be seen from the drawing, for odd and also even lines, the paired scan electrode SCN(i) and sustain electrode SUS(i) are applied with sustain discharge current in opposite directions. Then, a sustain discharge current always flows simultaneously in the scan and sustain electrodes in the opposite directions because it is applied from scan electrode drive circuit 2 or sustain electrode drive circuit 3. This causes the electromagnetic noises emitted from sustain discharge currents flowing through the paired scan and sustain electrodes, SCN(i) and SUS(i), respectively to be cancelled by another. The same descriptions made to the first embodiment for the noise cancellation, using voltage and current waveforms, can be applied equally to this embodiment and, therefore, no further description will be made to this.

Next, in the second embodiment, as shown in FIG. 5, all of the paired scan electrodes SCN(1)–SCN(2M) and sustain electrodes SUS(1)–SUS(2M) are led out on one side of the panel 6, which prohibits each gap between neighboring electrodes from being extended. However, as shown in FIG. 5 by dotted lines, for the ineffective current flowing through the capacitance between electrodes where no sustain discharge would occur, e.g., the capacitance between sustain electrode SUS(2K-1) and scan electrode SCN(2K), currents in sustain electrode SUS(2K-1) and scan electrode SCN (2K), respectively, flow in the opposite directions, causing the electromagnetic noises due to sustain current to be cancelled by another.

The operations and advantages caused between (2K-1)-th and (2K)-th electrodes are obtained in the entire area of the panel 6 in FIG. 4. That is, each of the electromagnetic noise caused by sustain discharge current flowing in paired scan and sustain electrodes can be cancelled by another. Actually, tests showed that according to the 42-inch AC plasma display panel according to the second embodiment of the present invention, electromagnetic noises are reduced by about 18 dB compared with the conventional panel.

In conclusion, with the arrangements of the AC plasma display panels according to the first and second embodiments of the present invention, when the paired scan and sustain electrodes are biased, the current flows in opposite directions in the paired scan and sustain electrodes, minimizing the electromagnetic noises generated by the current.

THIRD EMBODIMENT

Figure 10:
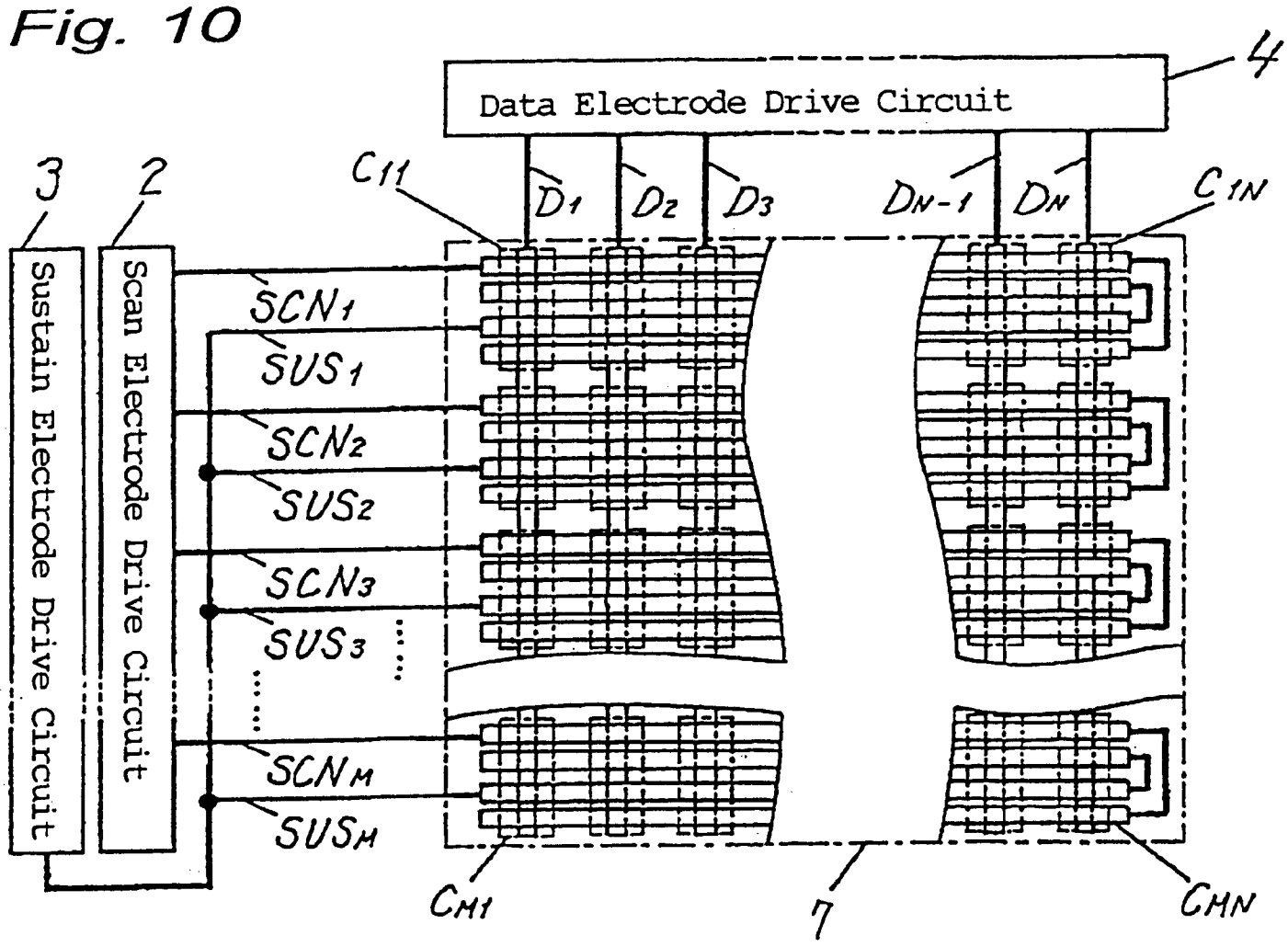
FIG. 10 is a schematic elevational view of an AC plasma display panel according to the third embodiment of the present invention.

Referring to FIG. 10, there is shown another AC plasma display system having a panel 7 and its drive circuit. The panel 7, which displays an image by generating sustain discharge between paired scan and sustain electrodes, includes two pairs of scan and sustain electrodes in each row. Also, in each row two parallel scan electrodes are electrically connected to each other on one side of the panel and also two parallel sustain electrodes are electrically connected to each other on the same side of the panel. One of the paired scan electrodes and one of the paired sustain electrodes are electrically connected with scan electrode drive circuit 2 and sustain electrode drive circuit 3, respectively, positioned on the opposite side of the panel. In each row, the plurality of electrodes, i.e., first scan electrode connected with scan electrode drive circuit 2, first sustain electrode, second sustain electrode connected with sustain electrode drive circuit 3, and the second scan electrode, are positioned in this order. Also, each of M rows of scan electrodes SCN(1)–SCN(M) includes two scan electrodes connected to each other. Likewise, each of M rows of sustain electrodes SUS(1)–SUS(M) includes two sustain electrodes connected to each other. Further, M rows of scan electrodes SCN(1)–SCN(M) and sustain electrodes SUS(1)–SUS(M) define discharge cells C(1,1)–C(M,N) at intersections with data electrodes D(1)–D(N). In this manner, the panel 7 is formed with a number of discharge cells in the form of M by N matrix. Also, each discharge cell is defined by two pairs of scan and sustain electrodes.

With this arrangement, the panel 7 can be operated in the conventional manner shown according to the operational time chart shown in FIG. 23 which has been described above and therefore no further description will be made to this.

Hereinafter, operations and advantages of the AC plasma display panel according to the third embodiment of the present invention will be described.

Figure 11:
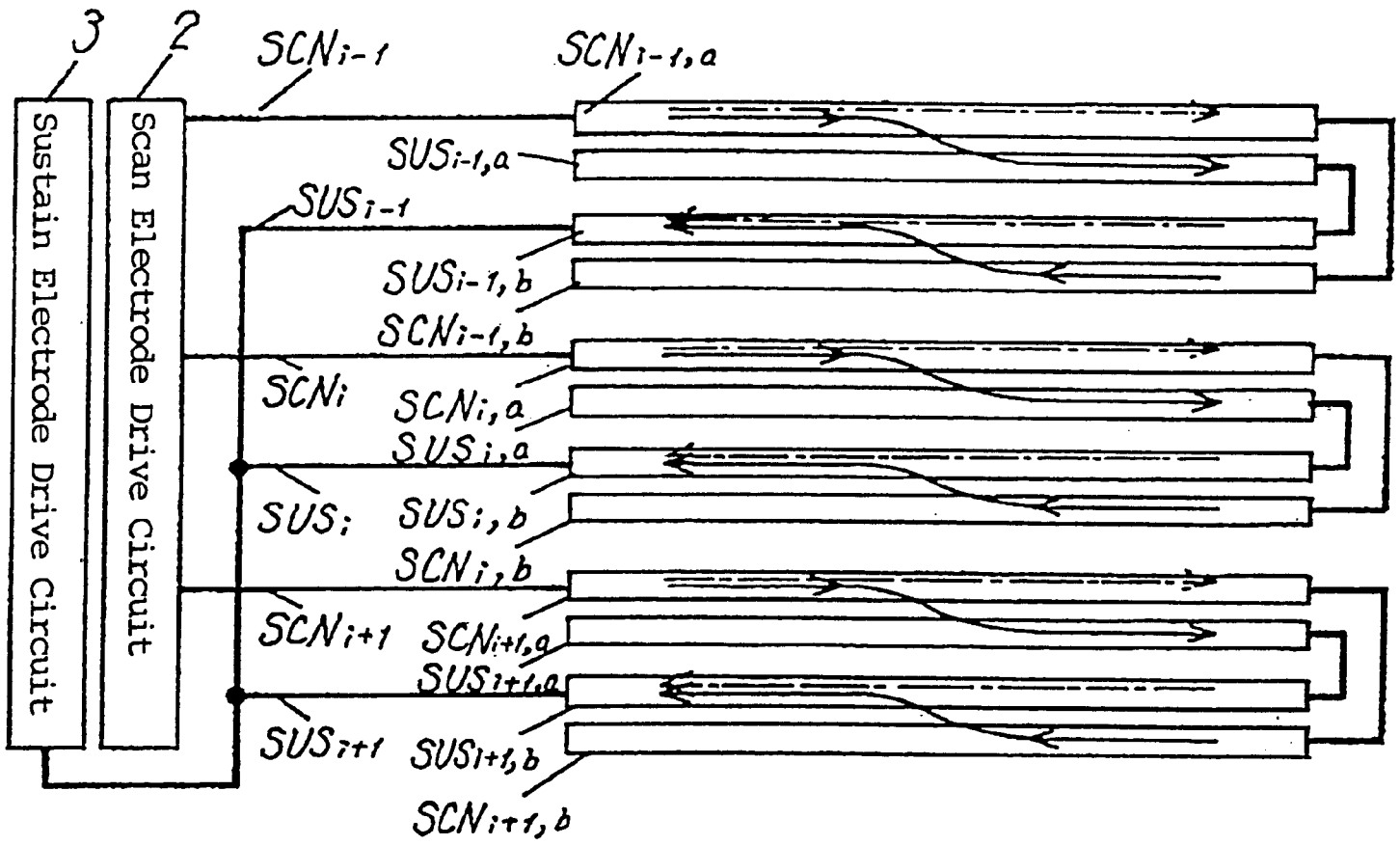
FIG. 11 is a partial schematic elevational view of the AC plasma display panel in FIG. 10.

FIG. 11 shows electrodes in (i–1)-th to (i+1)-th rows together with scan and sustain electrode drive circuits 2 and 3 connected to the electrodes. Also, FIG. 11 shows sustain discharge current (shown by solid lines) generated by an application of negative sustain pulse of −Vm volts to all of sustain electrode SUS(1)–SUS(M) at a certain time (t) in sustain period shown in FIG. 23. As can be seen from the drawing, in each row two sustain discharge currents flowing in the paired scan and sustain electrodes run in the opposite directions. For example, in row (i) the first discharge current from one scan electrode SCN(i,a) to one sustain electrode SUS(i,a) flows in the opposite direction against the second discharge current from the other scan electrode SCN(i,b) to the other sustain electrode SUS(i,b).

Also, discharge sustain current from scan electrode SCN (i,a) to sustain electrode SUS(i,a) flows from sustain electrode SUS(i,b) to sustain electrode drive circuit 3 as shown by long and short dotted line. Another discharge sustain current from scan electrode SCN(i,b) to sustain electrode SUS(i,b) flows from scan electrode drive circuit 2 to scan electrode SCN(i,a) as shown by another long and short dotted line. As can be seen from above, directions indicated by respective long and short dotted lines are opposite to the other.

Therefore, electromagnetic noises generated by two discharge currents that flow the paired scan and sustain electrodes take opposite phases, which functions to cancel the other to minimize the electromagnetic noise from the panel. Also, no current flows through the capacitance between one pair of scan and sustain electrodes and another pair of scan and sustain electrodes in the same row, e.g., between sustain electrode SUS(i,b) and another sustain electrode SUS(i,a), because they are on the same voltage level. Likewise, no current flows through the capacitance between a pair of scan and sustain electrodes and a pair of scan and sustain electrodes in the neighboring row, e.g., from scan electrode SCN(i,a) to another scan electrode SCN(i-1,b), because they are on the same voltage level. Therefore, electromagnetic noise from the AC plasma display panel can be reduced significantly. Note that a small portion of the electromagnetic noise generated from the panel is from others rather than sustain pulses, which is not problematic to the practical use of the panel.

FOURTH EMBODIMENT

Figure 12:
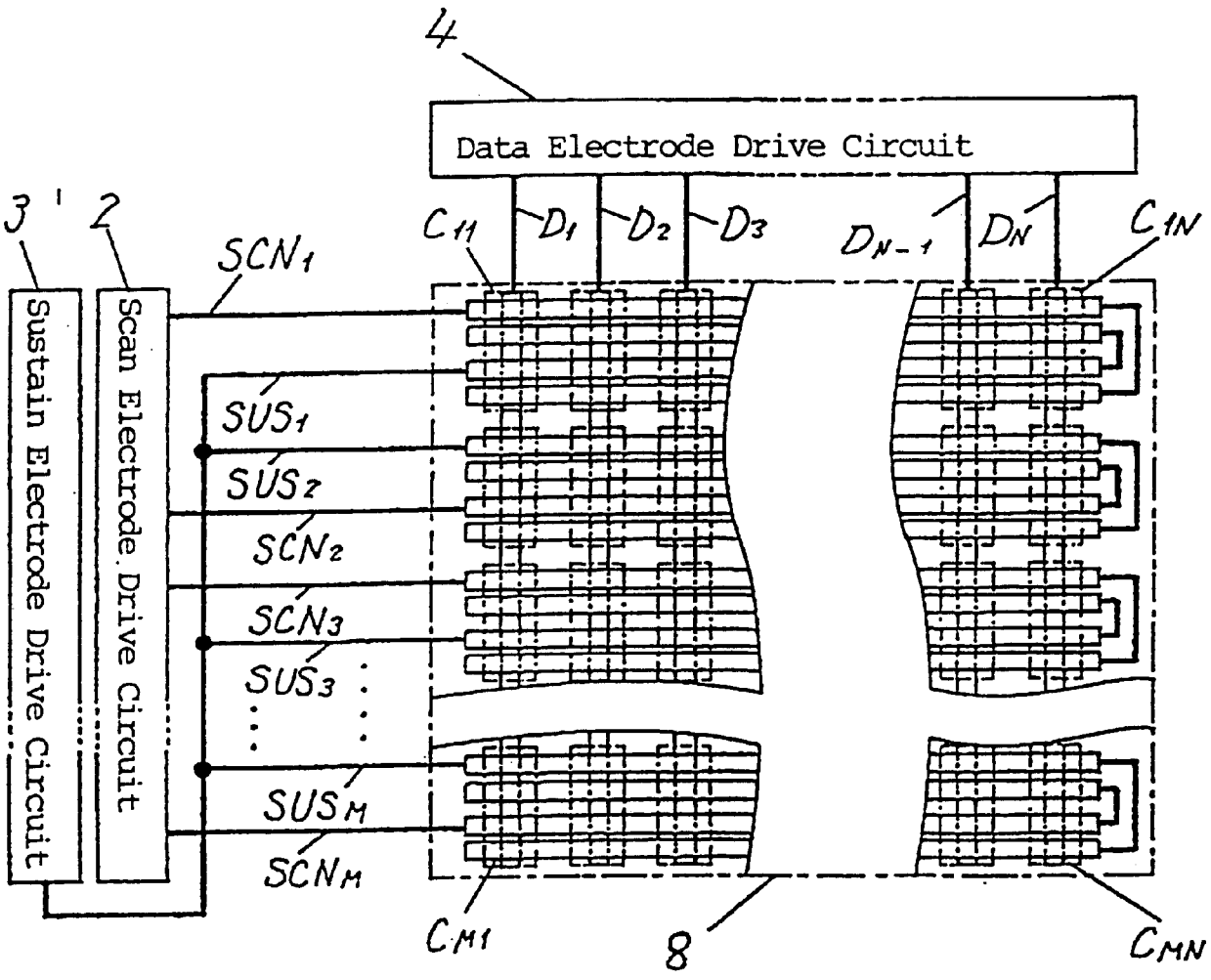
FIG. 12 is a schematic elevational view of an AC plasma display panel according to the fourth embodiment of the present invention.

FIG. 12 shows an AC plasma display panel according to the fourth embodiment of the present invention. As can be seen from the drawing, the AC plasma display panel includes a panel 8 and its drive circuit, in which a sustain discharge is generated between each pair of scan and sustain electrodes for display. For this purpose, in the panel each row has two pairs of scan and sustain electrodes. Also, in each row the two scan electrodes as well as the two sustain electrodes are connected to each other on one side of the panel, and one of the two scan electrodes and one of the two sustain electrodes are electrically connected with scan electrode drive circuit 2 and sustain electrode drive circuit 3, respectively. In addition, in odd row four electrodes, i.e., first scan electrode connected to scan electrode drive circuit 2, first sustain electrode, second sustain electrode connected to sustain electrode drive circuit 3, and second scan electrode, are positioned in this order. On the other hand, in even row, four electrodes, i.e., first sustain electrode connected to sustain electrode drive circuit 3, first scan electrode, second scan electrode connected to scan electrode drive circuit 2, and second sustain electrode, are positioned in this order. In this manner, the panel includes M rows of scan electrodes SCN(1)–SCN(M), each of which row including two scan electrodes connected to each other. Likewise, the panel includes M rows of sustain electrodes SUS(1)–SUS(M), each of which row including two sustain electrodes connected to each other. Also, M rows of scan and sustain electrodes, SCN(1)–SCN(M) and SUS(1)–SUS(M), cooperate with N columns of data electrodes D(1)–D(N) to form a plurality of discharge cells C(1,1)–C(M,N) at their intersections. As described above, the panel 8 includes two pairs of scan and sustain electrodes in each discharge cell and defines discharge cells C(1,1)–C(M,N) in the form of M by N matrix.

With this arrangement, the panel 8 can be operated in the conventional manner shown according to the operational time chart shown in FIG. 23 which has been described above and therefore no further description will be made to this.

Hereinafter, operations and advantages of the AC plasma display panel according to the fourth embodiment of the present invention will be described.

Figure 13:
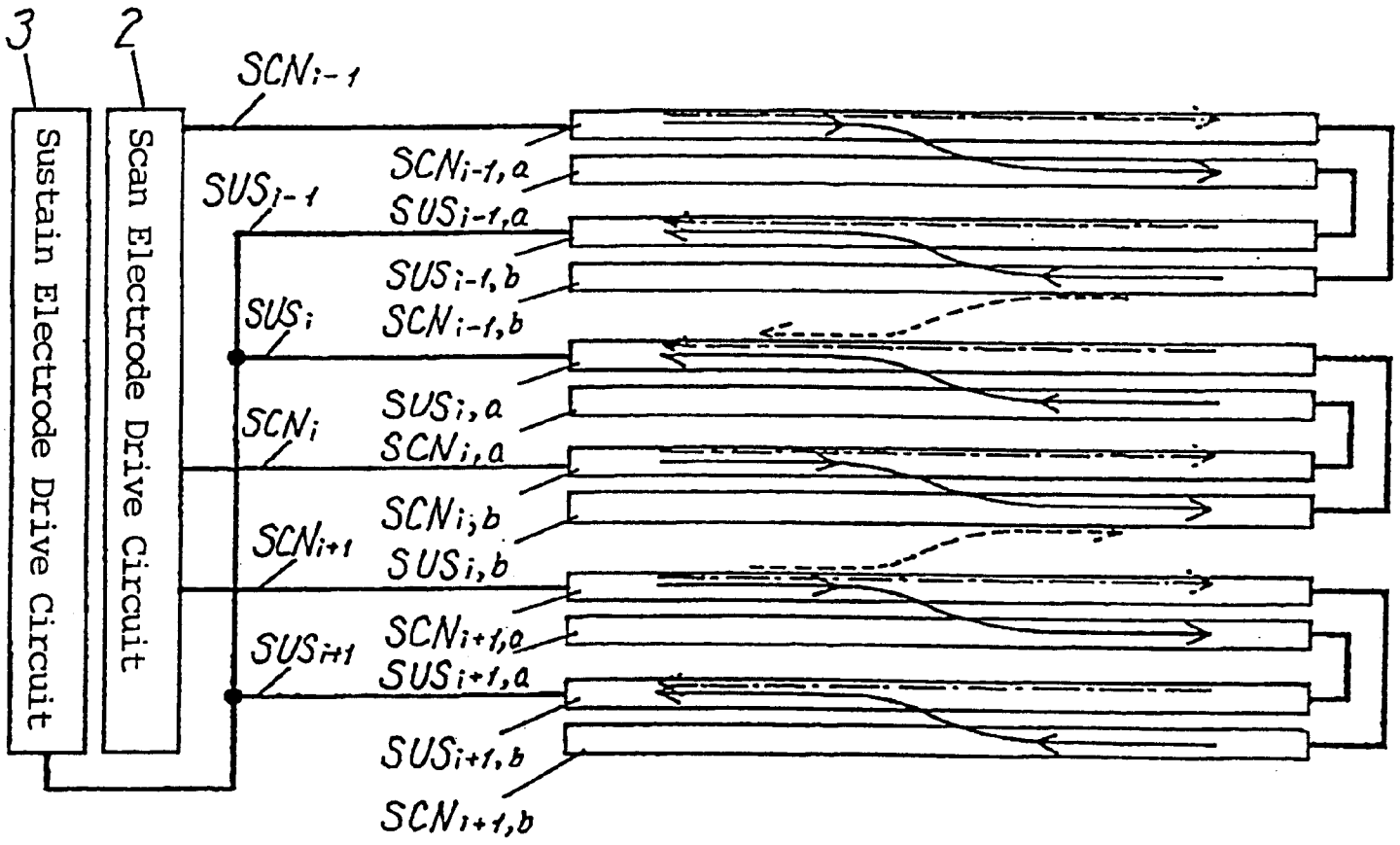
FIG. 13 is a partial schematic elevational view of the AC plasma display panel in FIG. 12.

FIG. 13 shows electrodes in (i–1)-th to (i+1)-th rows together with scan and sustain electrode drive circuits 2 and 3 connected to the electrodes. Also, FIG. 13 shows sustain discharge current (shown by solid lines) generated by an application of negative sustain pulse of −Vm volts to all of sustain electrode SUS(1)–SUS(M) at a certain time (t) in sustain period shown in FIG. 23. As can be seen from the drawing, in each row two sustain discharge currents flowing in the paired scan and sustain electrodes run in the opposite directions. For example, in row (i) the first discharge current from one scan electrode SCN(i,a) to one sustain electrode SUS(i,a) flows in the opposite direction against the second discharge current from the other scan electrode SCN(i,b) to the other sustain electrode SUS(i,b).

Also, sustain discharge current from scan electrode SCN (i,a) to sustain electrode SUS(i,a) flows from scan electrode drive circuit 2 to scan electrode SCN(i,b) as shown by long and short dotted line. Another sustain discharge current from scan electrode SCN(i,b) to sustain electrode SUS(i,b) flows from sustain electrode SUS(i,a) to sustain electrode drive circuit 3 as shown by another long and short dotted line. As can be seen from above, directions indicated by respective long and short dotted lines are opposite to the other.

Therefore, electromagnetic noises generated by two discharge currents that flow the paired scan and sustain electrodes take opposite phases, which functions to cancel the other to minimize the electromagnetic noise from the panel.

Also, no current flows through the capacitance between a pair of scan and sustain electrodes and another pair of scan and sustain electrodes in the same row, e.g., from one scan electrode SCN(i,b) to the other scan electrode SCN(i,a), because they are on the same voltage level. Further, as shown in FIG. 13 by the broken line current flows through the capacitance between a pair of scan and sustain electrodes in one row and a pair of scan and sustain electrodes in the neighboring row. E.g., the current from scan electrode SCN(i-1,b) to sustain electrode SUS(i,a) and the current from scan electrode SCN(i+1,a) to sustain electrode SUS(i, b), flow opposite to each other. Therefore, electromagnetic noise generated in one row is cancelled by electromagnetic noise generated in the neighboring row, minimizing the electromagnetic noise emitted from the panel. Note that a small portion of the electromagnetic noise generated from the panel is from others rather than sustain pulses, which is not problematic to the practical use of the panel.

FIFTH EMBODIMENT

Figure 14:
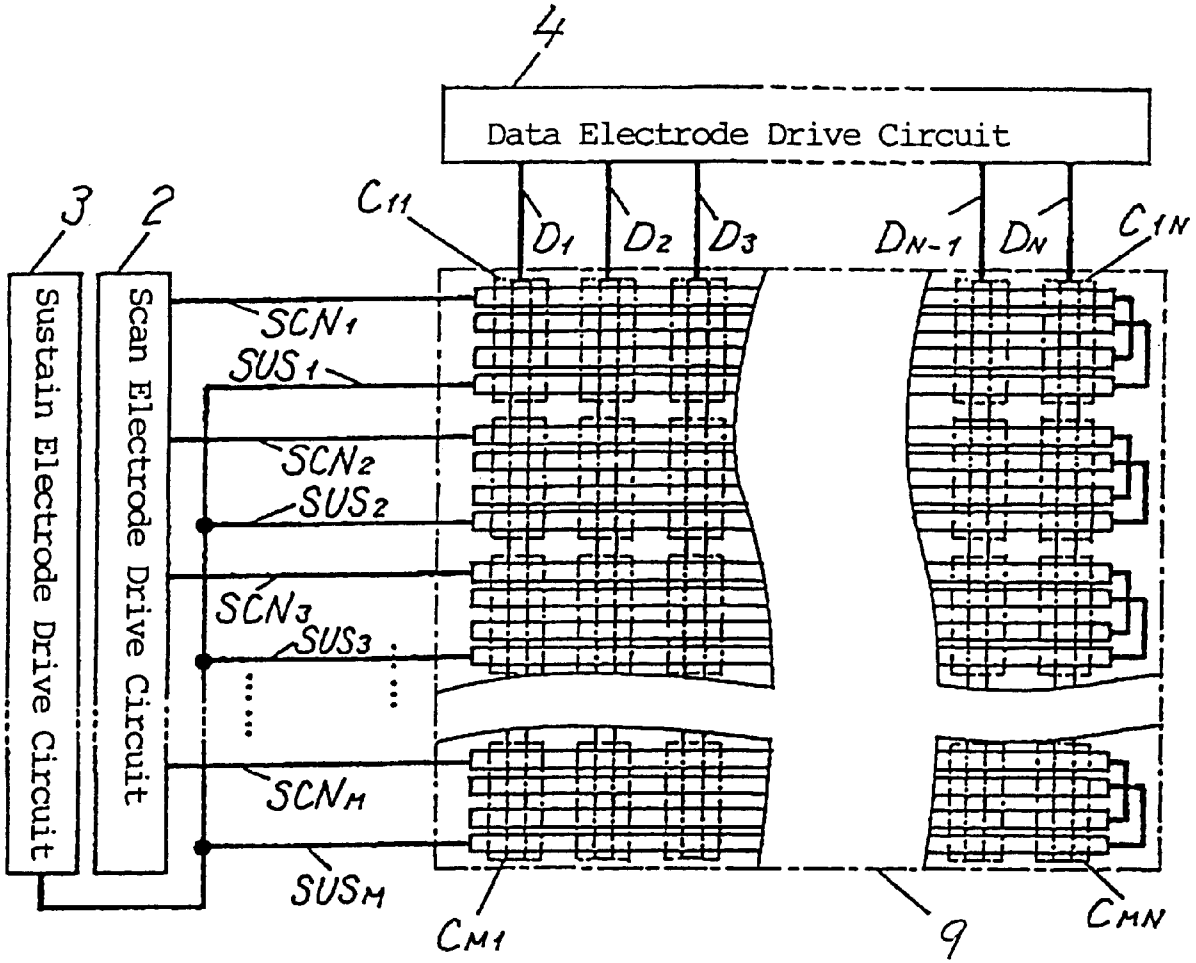
FIG. 14 is a schematic elevational view of an AC plasma display panel according to the fifth embodiment of the present invention.

FIG. 14 shows an AC plasma display panel according to the fifth embodiment of the present invention. As can be seen from the drawing, the AC plasma display panel includes a panel 9 and its drive circuit, in which a sustain discharge is generated between each pair of scan and sustain electrodes for display. For this purpose, in the panel each row has two pairs of scan and sustain electrodes. Also, in each row the two scan electrodes as well as the two sustain electrodes are connected to each other on one side of the panel, and one of the two scan electrodes and one of the two sustain electrodes are electrically connected with scan electrode drive circuit 2 and sustain electrode drive circuit 3, respectively. In addition, in each row four electrodes, i.e., first scan electrode connected to scan electrode drive circuit 2, first sustain electrode, second scan electrode, and second sustain electrode connected to sustain electrode drive circuit 3, are positioned in this order. In this manner, the panel includes M rows of scan electrodes SCN(1)–SCN(M), each of which row including two scan electrodes connected to each other. Likewise, the panel includes M rows of sustain electrodes SUS(1)–SUS(M), each of which row including two sustain electrodes connected to each other. Also, M rows of scan and sustain electrodes, SCN(1)–SCN(M) and SUS (1)–SUS(M), cooperate with N columns of data electrodes D(1)–D(N) to form a plurality of discharge cells C(1,1)–C (M,N) at their intersections. As described above, the panel 9 includes two pairs of scan and sustain electrodes in each discharge cell and defines discharge cells C(1,1)–C(M,N) in the form of M by N matrix.

With this arrangement, the panel 9 can be operated in the conventional manner shown according to the operational time chart shown in FIG. 23 which has been described above and therefore no further description will be made to this.

Hereinafter, operations and advantages of the AC plasma display panel according to the fifth embodiment of the present invention will be described.

Figure 15:
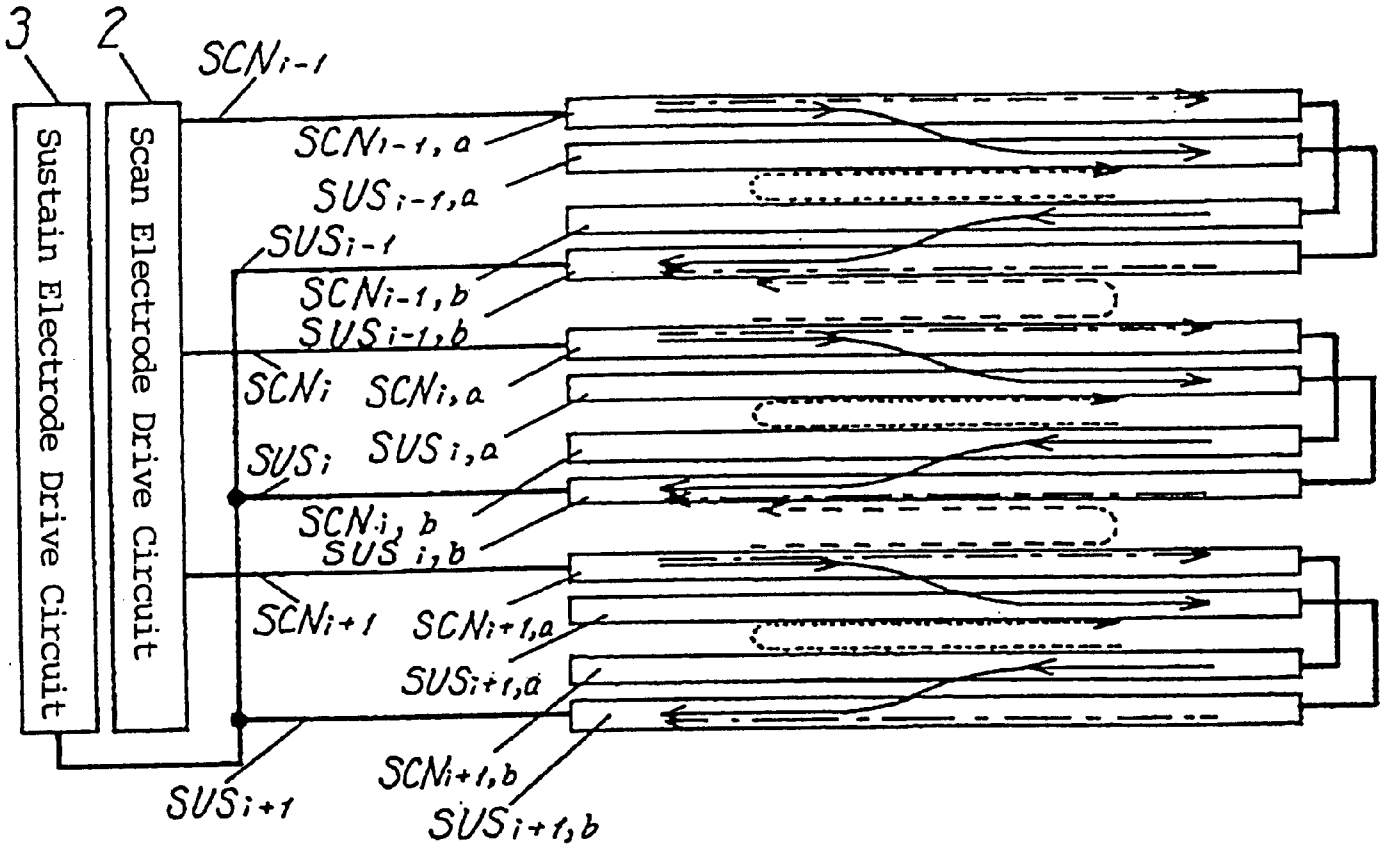
FIG. 15 is a partial schematic elevational view of the AC plasma display panel in FIG. 14.

FIG. 15 shows electrodes in (i–1)-th to (i+1)-th rows together with scan and sustain electrode drive circuits 2 and 3 connected to the electrodes. Also, FIG. 15 shows sustain current (shown by solid lines) generated by an application of negative sustain pulse of −Vm volts to all of sustain electrode SUS(1)–SUS(M) at a certain time (t) in sustain period shown in FIG. 23. As can be seen from the drawing, in each row two sustain discharge currents flowing in the paired scan and sustain electrodes run in the opposite directions. For example, in row (i) the first discharge current from one scan electrode SCN(i,a) to one sustain electrode SUS(i,a) flows in the opposite direction against the second discharge current from the other scan electrode SCN(i,b) to the other sustain electrode (i,b).

Also, sustain discharge current from scan electrode SCN (i,a) to sustain electrode SUS(i,a) flows from sustain electrode SUS(i,b) to sustain electrode drive circuit 3 as shown by long and short dotted line. Another discharge sustain current from scan electrode SCN(i,b) to sustain electrode SUS(i,b) flows from scan electrode drive circuit 2 to scan electrode SCN(i,a) as shown by another long and short dotted line. As can be seen from above, directions indicated by respective long and short dotted lines are opposite to the other.

Therefore, electromagnetic noises generated by two discharge currents that flow the paired scan and sustain electrodes take opposite phases, which function to cancel the other to minimize the electromagnetic noise from the panel.

Also, as shown in FIG. 15 by the dotted line, in each row current flows through the capacitance between a pair of scan and sustain electrodes and another pair of scan and sustain electrodes in the same row, e.g., from scan electrode SCN (i,b) to sustain electrode SUS(i,a). The current in scan electrode SCN(i,b) and that in sustain electrode SUS(i,a) flow in opposite directions. Further, as shown in FIG. 15 by the broken line current flows through the capacitance between a pair of scan and sustain electrodes and a pair of scan and sustain electrodes in the neighboring row, e.g., from scan electrode SCN(i,a) to sustain electrode SUS(i−1, b). The current in scan electrode SCN(i,a) and that in sustain electrode SUS(i−1,b) flow opposite to each other. Therefore, electromagnetic noise generated by the current between neighboring electrodes is cancelled by the electromagnetic noise generated by current flowing in those electrodes. Note that a small portion of the electromagnetic noise generated from the panel is from others rather than sustain pulses, which is not problematic to the practical use of the panel.

SIXTH EMBODIMENT

Figure 16:
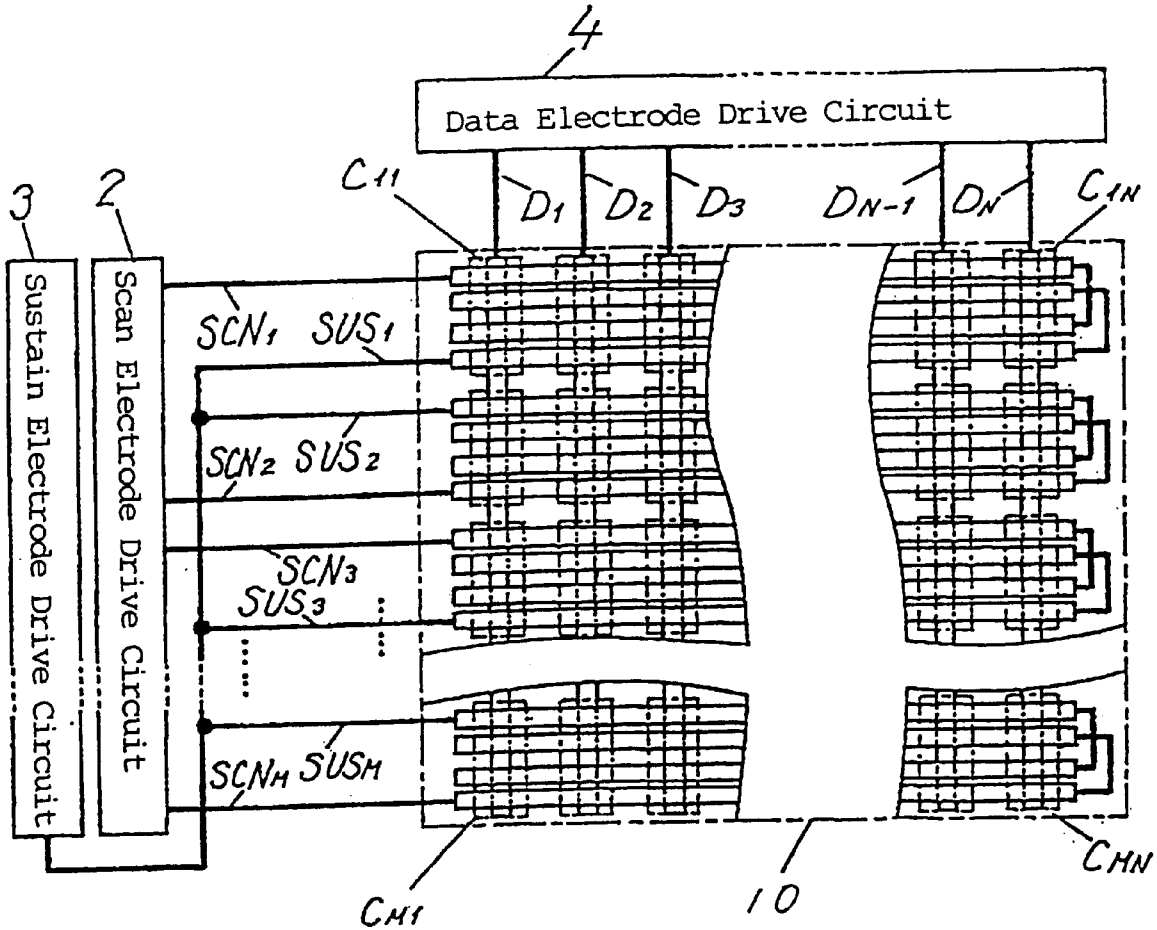
FIG. 16 is a schematic elevational view of an AC plasma display panel according to the sixth embodiment of the present invention.

FIG. 16 shows an AC plasma display panel according to the sixth embodiment of the present invention. As can be seen from the drawing, the AC plasma display panel includes a panel 10 and its drive circuit, in which a sustain discharge is generated between each pair of scan and sustain electrodes for display. For this purpose, in the panel each row has two pairs of scan and sustain electrodes. Also, in each row the two scan electrodes as well as the two sustain electrodes are connected to each other on one side of the panel, and one of the two scan electrodes and one of the two sustain electrodes are electrically connected with scan electrode drive circuit 2 and sustain electrode drive circuit 3, respectively. In addition, in odd row four electrodes, i.e., first scan electrode connected to scan electrode drive circuit 2, first sustain electrode, second scan electrode, and second sustain electrode connected to sustain electrode drive circuit 3, are positioned in this order. On the other hand, in even row, four electrodes, i.e., first sustain electrode connected to sustain electrode drive circuit 3, first scan electrode, second sustain electrode and second scan electrode connected to scan electrode drive circuit 2, are positioned in this order. In this manner, the panel includes M rows of scan electrodes SCN(1)–SCN(M), each of which row including two scan electrodes connected to each other. Likewise, the panel includes M rows of sustain electrodes SUS(1)–SUS(M), each of which row including two sustain electrodes connected to each other. Also, M rows of scan and sustain electrodes, SCN(1)–SCN(M) and SUS(1)–SUS(M), cooperate with N columns of data electrodes D(1)–D(N) to form a plurality of discharge cells C(1,1)–C(M,N) at their intersections. As described above, the panel 10 includes two pairs of scan and sustain electrodes in each discharge cell and defines discharge cells C(1,1)–C(M,N) in the form of M by N matrix.

With this arrangement, the panel 10 can be operated in the conventional manner shown according to the operational time chart shown in FIG. 23 which has been described above and therefore no further description will be made to this.

Hereinafter, operations and advantages of the AC plasma display panel according to the sixth embodiment of the present invention will be described.

Figure 17:
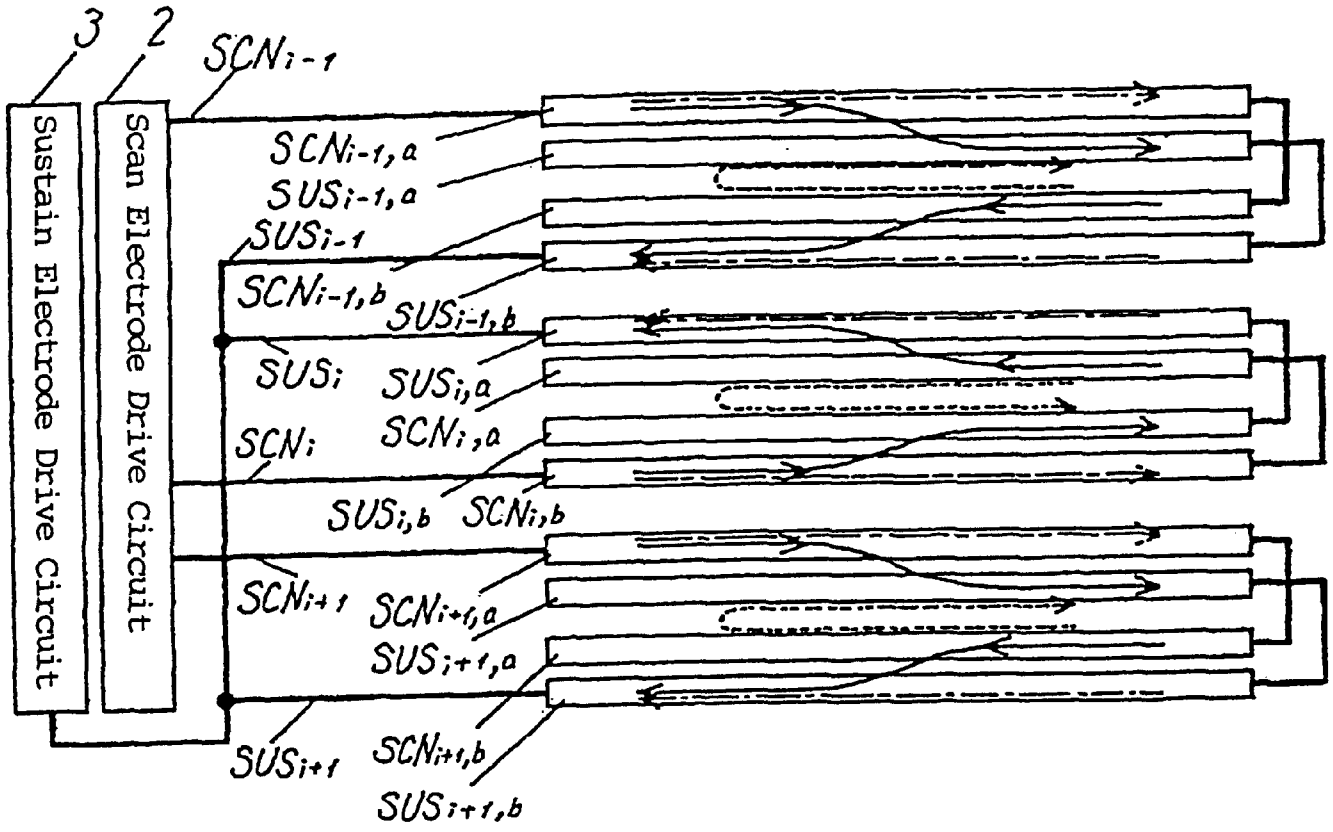
FIG. 17 is a partial schematic elevational view of the AC plasma display panel in FIG. 16.

FIG. 17 shows electrodes in (i−1)-th to (i+1)-th rows together with scan and sustain electrode drive circuits 2 and 3 connected to the electrodes. Also, FIG. 17 shows sustain discharge current (shown by solid lines) generated by an application of negative sustain pulse of −Vm volts to all of sustain electrode SUS(1)–SUS(M) at a certain time (t) in sustain period shown in FIG. 23. As can be seen from the drawing, in each row two sustain discharge currents flowing in the paired scan and sustain electrodes run in the opposite directions. For example, in row (i) the first discharge current from one scan electrode SCN(i,a) to one sustain electrode SUS(i,a) flows in the opposite direction against the second discharge current from the other scan electrode SCN(i,b) to the other sustain electrode SUS(i,b). P Also, sustain discharge current from scan electrode SCN(i,a) to sustain electrode SUS(i,a) flows from scan electrode drive circuit 2 to scan electrode SCN(i,b) as shown by long and short dotted line. Another discharge sustain current from scan electrode SCN(i,b) to sustain electrode SUS(i,b) flows from sustain electrode SUS(i,a) to sustain electrode drive circuit 3 as shown by another long and short dotted line. As can be seen from above, directions indicated by respective long and short dotted lines are opposite to the other.

Therefore, electromagnetic noises generated by two discharge currents that flow the paired scan and sustain electrodes take opposite phases, which function to cancel the other to minimize the electromagnetic noise from the panel.

Also, as shown in dotted line current from scan or sustain electrode in one pair to scan or sustain electrode in the other pair flows in opposite directions in those electrodes. For example, current flows in one direction in scan electrode SCN(i,a) and current flows in the opposite direction in sustain electrode SUS(i,b). Likewise, no current flows from one row to the neighboring row e.g., from sustain electrode SUS(i−1,b) to sustain electrode SUS(i,a), because they are on the same voltage level. Therefore, electromagnetic noise from the AC plasma display panel can be reduced significantly. Note that a small portion of the electromagnetic noise generated from the panel is from others rather than sustain pulses, which is not problematic to the practical use of the panel.

SEVENTH EMBODIMENT

Figure 18:
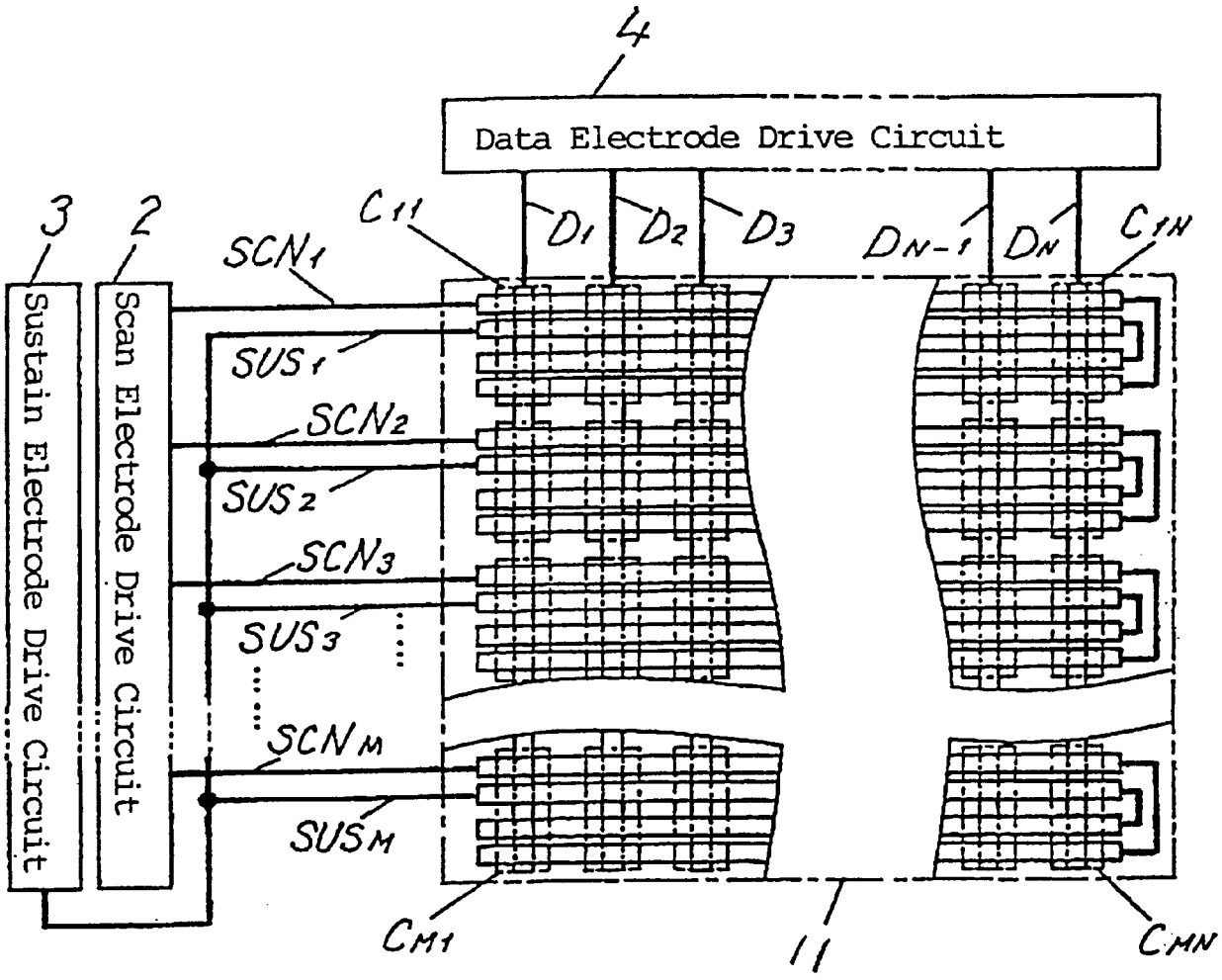
FIG. 18 is a schematic elevational view of an AC plasma display panel according to the seventh embodiment of the present invention.

FIG. 18 shows an AC plasma display panel according to the seventh embodiment of the present invention. As can be seen from the drawing, the AC plasma display panel includes a panel 11 and its drive circuit, in which a sustain discharge is generated between each pair of scan and sustain electrodes for display. For this purpose, in the panel each row has two pairs of scan and sustain electrodes. Also, in each row the two scan electrodes as well as the two sustain electrodes are connected to each other on one side of the panel, and one of the two scan electrodes and one of the two sustain electrodes are electrically connected with scan electrode drive circuit 2 and sustain electrode drive circuit 3, respectively. In addition, in each row four electrodes, i.e., first scan electrode connected to scan electrode drive circuit 2, first sustain electrode connected to sustain electrode drive circuit 3, second sustain electrode, and second scan electrode, are positioned in this order. In this manner, the panel includes M rows of scan electrodes SCN(1)–SCN(M), each of which row including two scan electrodes connected to each other. Likewise, the panel includes M rows of sustain electrodes SUS(1)–SUS(M), each of which row including two sustain electrodes connected to each other. Also, M rows of scan and sustain electrodes, SCN(1)–SCN(M) and SUS(1)–SUS(M), cooperate with N columns of data electrodes D(1)–D(N) to form a plurality of discharge cells C(1,1)–C(M,N) at their intersections. As described above, the panel 11 includes two pairs of scan and sustain electrodes in each discharge cell and defines discharge cells C(1,1)–C(M,N) in the form of M by N matrix.

With this arrangement, the panel 11 can be operated in the conventional manner shown according to the operational time chart shown in FIG. 23 which has been described above and therefore no further description will be made to this.

Hereinafter, operations and advantages of the AC plasma display panel according to the seventh embodiment of the present invention will be described.

Figure 19:
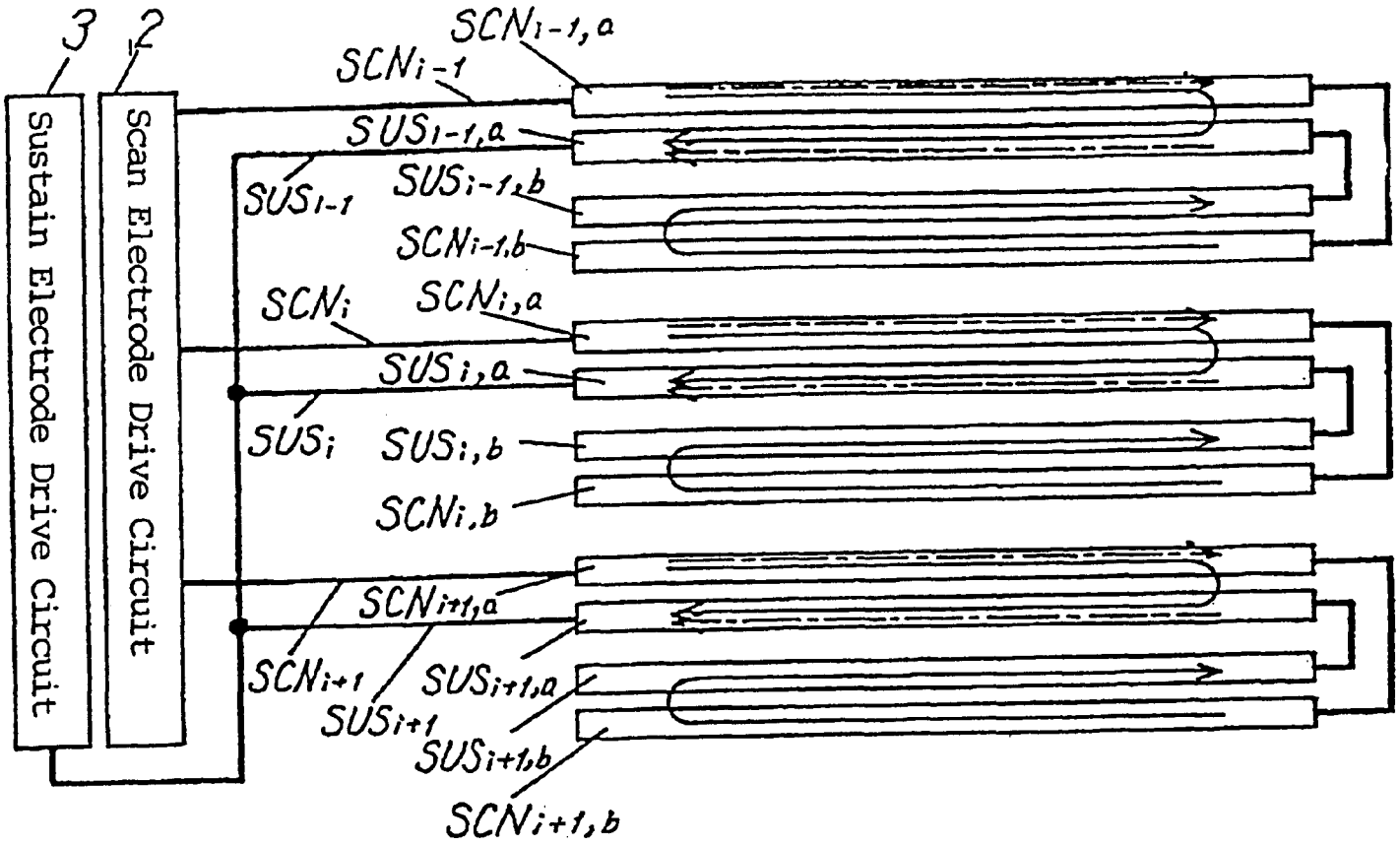
FIG. 19 is a partial schematic elevational view of the AC plasma display panel in FIG. 18.

FIG. 19 shows electrodes in (i−1)th to (i+1)th rows together with scan and sustain electrode drive circuits 2 and 3 connected to the electrodes. Also, FIG. 19 shows sustain discharge current (shown by solid lines) generated by an application of negative sustain pulse of −Vm volts to all of sustain electrode SUS(1)–SUS(M) at a certain time (t) in sustain period shown in FIG. 23. As can be seen from the drawing, in each sustain discharge current in every row, current in scan electrode and that in sustain electrode in the paired scan and sustain electrodes run in the opposite directions. For example, in the first discharge in row (i) current in one scan electrode SCN(i,a) and in one sustain electrode SUS(i,a) flows in the opposite direction, and also the second discharge in row (i), current in the other scan electrode SCN(i,b) and in the other sustain electrode SUS (i,b) flows in the opposite direction.

Also, discharge sustain current from scan electrode SCN (i,b) to sustain electrode SUS(i,b) flows from scan electrode drive circuit 2 via scan electrode SCN(i,a) and to sustain electrode drive circuit 3 via sustain electrode SUS(i,a), as shown by long and short dotted lines. Also, directions indicated by respective long and short dotted lines are opposite to the other.

Therefore, electromagnetic noises generated by the current in scan electrode and that in sustain electrode in the paired scan and sustain electrodes take opposite phases respectively, which function to cancel each other to minimize the electromagnetic noise from the panel.

Also, in each row, one current from scan or sustain electrode in one pair to scan or sustain electrode in the other pair corresponds to that flows, for example, between sustain electrode SUS(i,b) and sustain electrode SUS(i,a) having the same voltage level, can be zero. Further, current flowing between neighboring rows corresponds to that flows, for example, between scan electrode SCN(i,a) and scan electrode SCN(i−1,b) having the same voltage level. Therefore, one electromagnetic noise is cancelled by another, minimizing the electromagnetic noise from the panel. Note that a small portion of the electromagnetic noise generated from the panel is from others rather than sustain pulses, which is not problematic to the practical use of the panel.

EIGHTH EMBODIMENT

Figure 20:
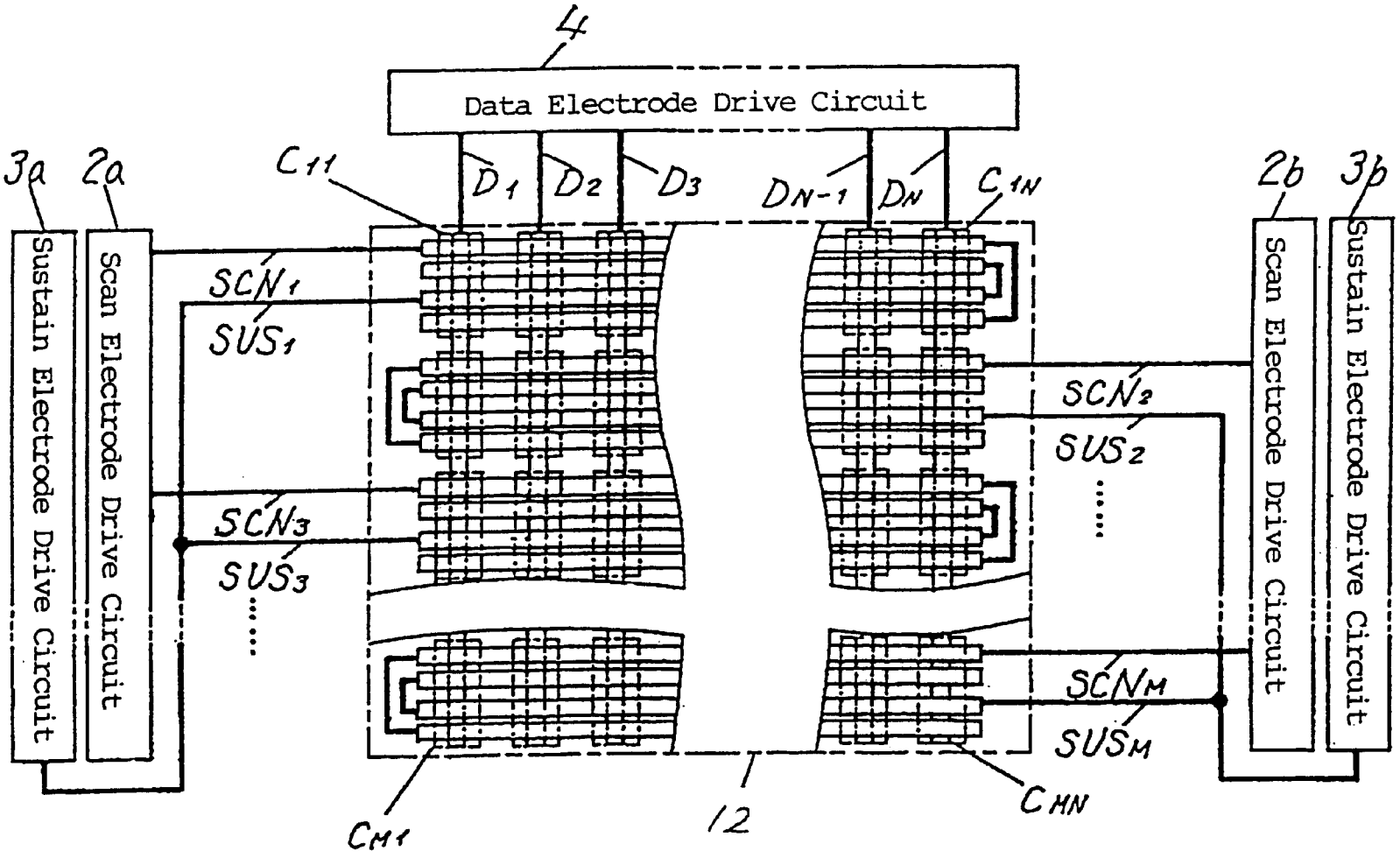
FIG. 20 is a schematic elevational view of an AC plasma display panel according to the eighth embodiment of the present invention.

FIG. 20 shows an AC plasma display panel according to the fourth embodiment of the present invention. As can be seen from the drawing, the AC plasma display panel includes a panel 12 and its drive circuit, in which a sustain discharge is generated between each pair of scan and sustain electrodes for display. For this purpose, in the panel each row has two pairs of scan and sustain electrodes. Also, in odd row the two scan electrodes as well as the two sustain electrodes are connected to each other on the right side of the panel, and one of the two scan electrodes and one of the two sustain electrodes are electrically connected with scan electrode drive circuit 2*a* and sustain electrode drive circuit 3*a*, respectively, on the left side of the panel. In even row the two scan electrodes as well as the two sustain electrodes are connected to each other on the left side of the panel, and one of the two scan electrodes and one of the two sustain electrodes are electrically connected with scan electrode drive circuit 2*b* and sustain electrode drive circuit 3*b*, respectively, on the right side of the panel.

Figure 23:
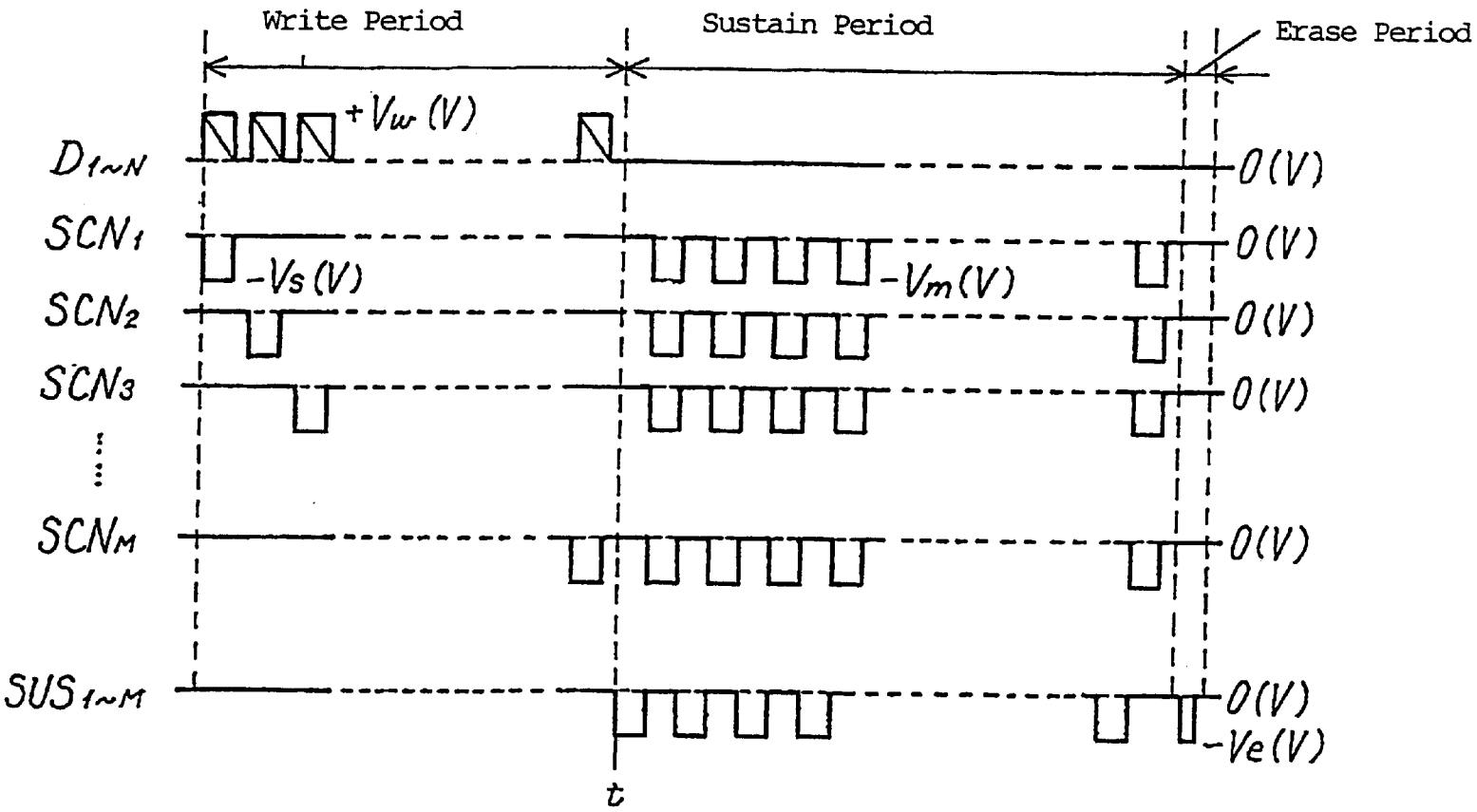
Fig. 23 Prior Art
FIG. 23 is a time chart showing pulses applied to electrodes in the AC plasma display panel shown in FIG. 22.
Figure 24:
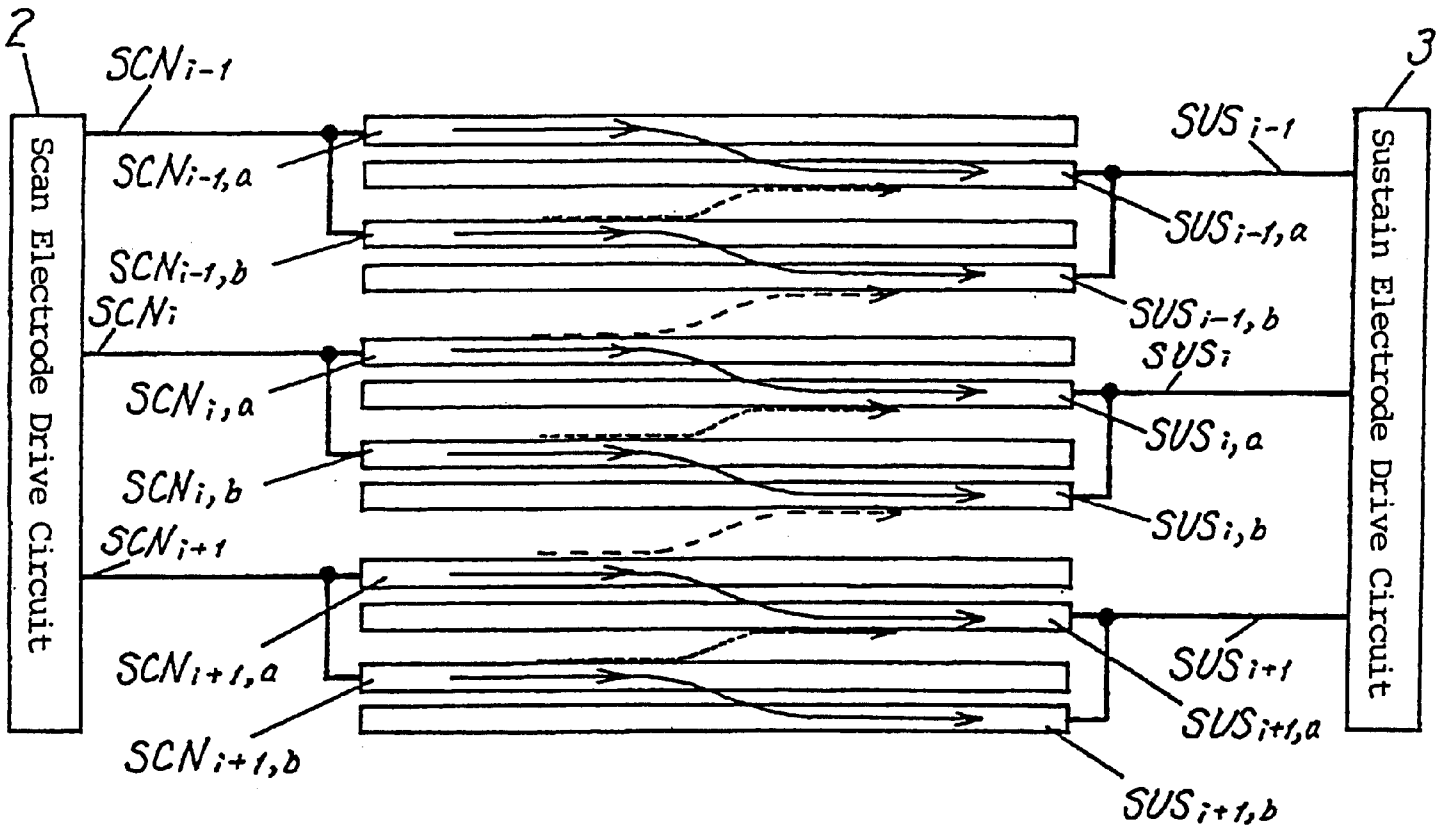
Fig. 24 Prior Art
FIG. 24 is a partial schematic elevational view of the conventional AC plasma display panel showing an arrangement of the electrodes.

With this arrangement, the panel 12 can be operated in the conventional manner shown according to the operational time chart shown in FIG. 23 in which scan electrode drive circuits 2*a* and 2*b* may be driven at the same time and also sustain electrode drive circuits 3*a* and 3*b* may be driven at the same time. Those operations are the same as described above and therefore no further description will be made to this.

Hereinafter, operations and advantages of the AC plasma display panel according to the eighth embodiment of the present invention will be described.

Figure 21:
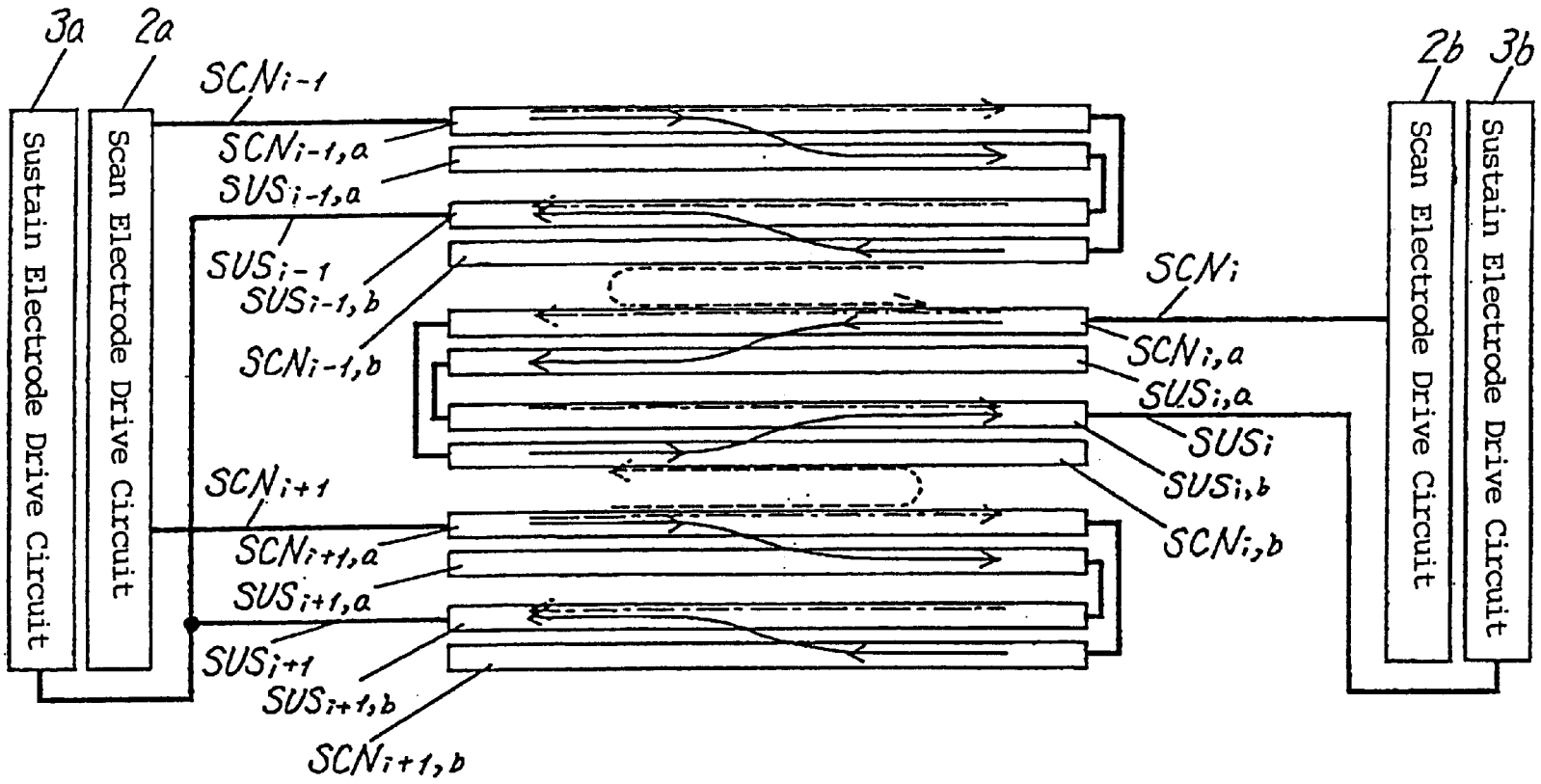
FIG. 21 is a partial schematic elevational view of the AC plasma display panel in FIG. 20.
Figure 22:
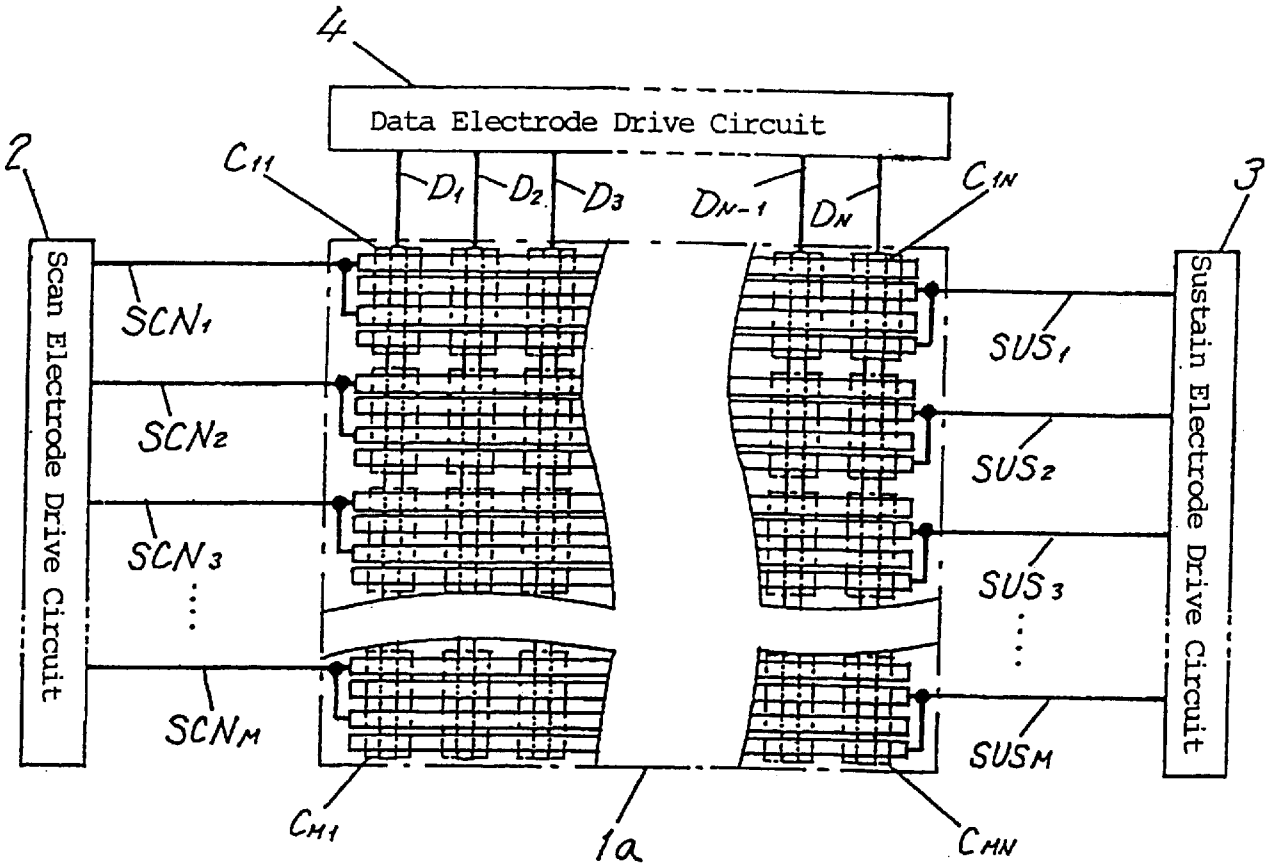
Fig. 22 Prior Art
FIG. 22 is a schematic elevational view of a conventional AC plasma display panel.

FIG. 21 shows electrodes in (i−1)th to (i+1)th rows together with scan and sustain electrode drive circuits 2 and 3 connected to the electrodes. Also, FIG. 21 shows sustain discharge current (shown by solid lines) generated by an application of negative sustain pulse of −Vm volts to all of sustain electrode SUS(1)–SUS(M) at a certain time (t) in sustain period shown in FIG. 23. As can be seen from the drawing, in each row two sustain discharge currents flowing in the paired scan and sustain electrodes run in the opposite directions. For example, in row (i) the first discharge current from one scan electrode SCN(i,a) to one sustain electrode SUS(i,a) flows in the opposite direction against the second discharge current from the other scan electrode SCN(i,b) to the other sustain electrode SUS(i,b).

Also, sustain discharge current from scan electrode SCN (i,a) to sustain electrode SUS(i,a) flows via sustain electrode SUS(i,b) to sustain electrode drive circuit 3*b* as shown by long and short dotted line. Another discharge sustain current from scan electrode SCN(i,b) to sustain electrode SUS(i,b) flows from scan electrode drive circuit 2*b* via scan electrode SCN(i,a) as shown by another long and short dotted line. As can be seen from above, directions indicated by respective long and short dotted lines are opposite to the other.

Therefore, electromagnetic noises generated by two discharge currents that flow the paired scan and sustain electrodes take opposite phases, which function to cancel the other to minimize the electromagnetic noise from the panel.

Also, in each row, one current from scan or sustain electrode in one pair to scan or sustain electrode in the other pair corresponds to that flows, for example, between sustain electrode SUS(i,b) and sustain electrode SUS(i,a) having the same voltage level, can be zero. Further, as shown by the broken lines, current flows between neighboring rows only when pulses from two scan electrode drive circuit 2*a* and 2*b* does not applied at the same time. Even when such current flows, current flows in scan electrode SCN(i−1,b) in opposite direction to that in scan electrode SCN(i,a), for example. Therefore, one electromagnetic noise is cancelled by another, minimizing the electromagnetic noise from the panel. Note that a small portion of the electromagnetic noise generated from the panel is from others rather than sustain pulses, which is not problematic to the practical use of the panel.

Although the present invention has been fully described, further modifications and improvements can be conceived in which the arrangement of scan and sustain electrodes and the connection with drive circuits are changed.

What is claimed is:

1. An AC plasma display panel, comprising:

a plurality of discharge cells, said plurality of discharge cells being arranged in a matrix made of plurality of rows and columns, wherein each of said discharge cells includes two pairs of scan and sustain electrodes extending in one direction and a data electrode extending substantially perpendicular to said one direction, means for applying a certain current to said scan and sustain electrodes so that said current in one of said two pairs flows in one direction and said current in the other of said two pairs flows in the opposite direction.

2. An AC plasma display panel according to claim 1, wherein current flow through a capacitance between a pair of scan and sustain electrodes and a pair of scan and sustain electrodes in neighboring row so that an electromagnetic noise generated from the current counteracts by itself.

3. An AC plasma display panel according to claim 1, wherein current flow through a capacitance between a pair of scan and sustain electrodes and another pair of scan and sustain electrodes in the same row so that an electromagnetic noise generated from the current counteracts by itself.

4. An AC plasma display panel according to claim 1, wherein first and second current flow through a capacitance between a pair of scan and sustain electrodes and a pair of scan and sustain electrodes in neighboring row and in the other neighboring row respectively so that an electromagnetic noise generated from the first current counteracts with another electromagnetic noises generated from the second current.

5. An AC plasma display panel, comprising:

a plurality of discharge cells, said plurality of discharge cells being arranged in a matrix made of plurality of rows and columns, wherein each of said discharge cells includes two pairs of scan and sustain electrodes extending in one direction and a data electrode extending substantially perpendicular to said one direction, means for applying a certain current to said scan and sustain electrodes so that said current in said paired scan and sustain electrodes respectively flows in the opposite direction each other.

6. An AC plasma display panel according to claim 5, wherein each neighboring two of said rows are designed so that one of said scan electrodes in one row is positioned adjacent to one of said scan electrodes in the other row.

7. An AC plasma display panel according to claim 5, wherein in each row said scan electrodes are connected to each other and said sustain electrodes are connected to each other.

8. An AC plasma display panel, comprising:

a plurality of parallel scan electrodes;

a plurality of parallel sustain electrodes, each of said sustain electrodes extending parallel to said plurality of scan electrodes, wherein said plurality of scan and sustain electrodes are positioned so that each one of said scan and sustain electrodes positions adjacent to and paired with the other one of scan and sustain electrodes;

a plurality of parallel data electrodes, said data electrodes extending substantially perpendicular to said scan and sustain electrodes to form discharge cells at intersections of said scan and sustain electrodes and said data electrodes, wherein each of said discharge cells is defined by two pairs of scan and sustain electrodes and said data electrode;

means for applying a certain current to each of said paired scan and sustain electrodes, said current in one of said two pairs flows in one direction and said current in the other of said two pairs flows in the opposite direction.

* * * * *